US009587177B2

(12) United States Patent
Van Der Merwe et al.

(10) Patent No.: US 9,587,177 B2
(45) Date of Patent: Mar. 7, 2017

(54) ENHANCED TURNDOWN PROCESS FOR A BITUMEN FROTH TREATMENT OPERATION

(75) Inventors: Shawn Van Der Merwe, Calgary (CA); Thomas Hann, Onoway (CA); Benjamin John Grappolini, Calgary (CA)

(73) Assignee: FORT HILLS ENERGY L.P., Calgary (CA)

( * ) Notice: Subject to any disclaimer, the term of this patent is extended or adjusted under 35 U.S.C. 154(b) by 364 days.

(21) Appl. No.: 14/114,323

(22) PCT Filed: Apr. 19, 2012

(86) PCT No.: PCT/CA2012/050247

§ 371 (c)(1),
(2), (4) Date: Oct. 28, 2013

(87) PCT Pub. No.: WO2012/149648

PCT Pub. Date: Nov. 8, 2012

(65) Prior Publication Data

US 2014/0048450 A1 Feb. 20, 2014

(51) Int. Cl.
*C10G 1/04* (2006.01)

(52) U.S. Cl.
CPC ..... *C10G 1/045* (2013.01); *C10G 2300/206* (2013.01); *C10G 2300/4081* (2013.01); *C10G 2300/44* (2013.01); *C10G 2300/807* (2013.01)

(58) Field of Classification Search
CPC ..... C10G 1/00; C10G 1/04; C10G 1/045; C10G 21/00; C10G 21/30;
(Continued)

(56) References Cited

U.S. PATENT DOCUMENTS 181,668 A 8/1876 Gregg et al.
654,965 A 7/1900 Franke
(Continued)

FOREIGN PATENT DOCUMENTS

CA 1027501 A1 3/1978
CA 1055868 6/1979
(Continued)

OTHER PUBLICATIONS

Andrews et al. "Great Canadian Oil Sands Experience in Commercial Processing of Athabasca Tar Sands" American Chemical Society San Francisco Meeting Apr. 2-5, 1968, p. F5-F18.
(Continued)

*Primary Examiner* — Prem C Singh
*Assistant Examiner* — Brandi M Doyle
(74) *Attorney, Agent, or Firm* — Marshall, Gerstein & Borun LLP

(57) ABSTRACT

More particularly, the model was a dynamic simulation built in HYSYS™ v7.1. The component slate was simplified and selected to give a vapor and two liquid phases, and have the ability to measure an S/B ratio. All the unit operations were included and modeled as best fit within HYSYS™. Pumps were all modelled as standard HYSYS™ centrifugal pumps with performance curves, settlers were modelled as vertical 3-phase vessels with internal weir enabled—the overflow side of the weir is used to simulate the overflow vessels on the settlers. All proposed controllers were included with generic tuning parameters, which control the system process variable (PV) to match a set point (SP). The control algorithm incorporated master PV controllers such as S/B ratio to relate froth and solvent flows and maintain relative material balance relationship between the process streams involved. In this specific simulation, the solvent flows were assigned a slave relationship relative to the bitumen flow; that is, the solvent controller SP was reset based on the bitumen froth flow and the master S/B ratio.

35 Claims, 10 Drawing Sheets

(58) Field of Classification Search
CPC .... C10G 2300/4031; C10G 2300/4081; B01D 11/0484; B01D 11/0488; B01D 21/0018; B01D 21/2488; B01D 11/30; B01D 11/34; C02F 2209/40; C02F 2301/046
See application file for complete search history.

(56) References Cited

U.S. PATENT DOCUMENTS 1,085,135 A 1/1914 Kelly, Jr.
1,147,356 A 7/1915 Allen
1,159,044 A 11/1915 Kelly, Jr.
1,201,558 A 10/1916 Cobb
1,254,562 A 1/1918 Allen
1,261,671 A 4/1918 Zachert
1,494,375 A 5/1924 Reilly
1,754,119 A 4/1930 Pink
1,777,535 A 10/1930 Stratford
2,010,008 A 8/1935 Bray
2,047,989 A 7/1936 William
2,091,078 A 8/1937 McKittrick et al.
2,111,717 A 3/1938 Young
2,188,013 A 1/1940 Pilat et al.
2,240,008 A 4/1941 Atwell
2,410,483 A 11/1946 Dons et al.
2,853,426 A 9/1958 Peet
2,868,714 A 1/1959 Gilmore
3,081,823 A * 3/1963 Constantikes ..... F28F 27/00 165/295
3,220,193 A 11/1965 Sttohmeyer, Jr.
3,271,293 A 9/1966 Clark
3,278,415 A 10/1966 Doberenz et al.
3,291,569 A 12/1966 Rossi
3,575,842 A 4/1971 Simpson
3,705,491 A 12/1972 Foster-Pegg
3,779,902 A 12/1973 Mitchell et al.
3,808,120 A 4/1974 Smith
3,901,791 A 8/1975 Baillie
3,929,625 A 12/1975 Lucas
3,954,414 A 5/1976 Samson, Jr. et al.
3,957,655 A 5/1976 Barefoot
4,013,542 A 3/1977 Gudelis et al.
4,035,282 A 7/1977 Stuchberry et al.
4,115,241 A 9/1978 Harrison et al.
4,116,809 A 9/1978 Kizior
4,120,775 A 10/1978 Murray et al.
4,140,620 A 2/1979 Paulett
4,209,422 A 6/1980 Zimmerman et al.
4,210,820 A 7/1980 Wittig
4,230,467 A 10/1980 Buchwald
4,251,627 A 2/1981 Calamur
4,284,242 A 8/1981 Randell
4,314,974 A 2/1982 Libby et al.
4,315,815 A 2/1982 Gearhart
4,321,147 A 3/1982 McCoy et al.
4,324,652 A 4/1982 Hack
4,342,657 A 8/1982 Blair
4,346,560 A 8/1982 Rapier
4,395,330 A 7/1983 Auboir et al.
4,410,417 A 10/1983 Miller et al.
4,425,227 A 1/1984 Smith
4,461,696 A 7/1984 Bock et al.
4,470,899 A 9/1984 Miller et al.
4,495,057 A 1/1985 Amirijafari et al.
4,514,305 A 4/1985 Filby
4,518,479 A 5/1985 Schweigharett et al.
4,532,024 A 7/1985 Haschke et al.
4,539,093 A 9/1985 Friedman et al.
4,545,892 A 10/1985 Cymbalisty et al.
4,572,781 A 2/1986 Krasuk et al.
4,584,087 A 4/1986 Peck
4,609,455 A 9/1986 Weimer et al.
4,634,520 A 1/1987 Angelov et al.
4,640,767 A 2/1987 Zajic et al.
4,644,974 A 2/1987 Zingg
4,648,964 A 3/1987 Leto et al.
4,678,558 A 7/1987 Belluteau et al.
4,722,782 A 2/1988 Graham et al.
4,726,759 A 2/1988 Wegnwe
4,781,819 A 11/1988 Chirinos et al.
4,802,975 A 2/1989 Mehlberg
4,822,481 A 4/1989 Taylor
4,828,688 A 5/1989 Corti et al.
4,859,317 A 8/1989 Shelfantook et al.
4,888,108 A 12/1989 Farnand
4,906,355 A 3/1990 Lechnick et al.
4,929,341 A 5/1990 Thirumalachar et al.
4,931,072 A 6/1990 Striedieck
4,950,363 A 8/1990 Silvey
4,966,685 A 10/1990 Hall et al.
4,968,413 A 11/1990 Datta et al.
5,022,983 A 6/1991 Myers et al.
5,039,227 A 8/1991 Leung et al.
5,133,837 A 7/1992 Elmore
5,143,598 A 9/1992 Graham et al.
5,186,820 A 2/1993 Schultz et al.
5,223,148 A 6/1993 Tipman et al.
5,236,577 A * 8/1993 Tipman ..... C10G 1/047 208/390
5,264,118 A 11/1993 Cymerman et al.
5,282,984 A 2/1994 Ashrawi
5,298,167 A * 3/1994 Arnold ..... B01D 17/0208 210/703
5,443,046 A 8/1995 White
5,558,768 A 9/1996 Ikura et al.
5,645,714 A 7/1997 Strand et al.
5,690,811 A 11/1997 Davis et al.
5,817,398 A 10/1998 Hollander
5,871,634 A 2/1999 Wiehe et al.
5,876,592 A 3/1999 Tipman et al.
5,879,540 A 3/1999 Zinke et al.
5,914,010 A 6/1999 Hood et al.
5,937,817 A 8/1999 Schanz et al.
5,948,241 A 9/1999 Owen
5,954,277 A 9/1999 Maciejewski et al.
5,968,349 A 10/1999 Duyvesteyn et al.
5,985,138 A 11/1999 Humphreys
5,988,198 A 11/1999 Neiman et al.
5,997,723 A 12/1999 Wiehe et al.
6,004,455 A 12/1999 Rendall
6,007,708 A 12/1999 Allcock et al.
6,007,709 A 12/1999 Duyvesteyn et al.
6,019,888 A 2/2000 Mishra et al.
6,036,748 A 3/2000 Wallace et al.
6,076,753 A 6/2000 Maciejewski et al.
6,110,359 A 8/2000 Davis et al.
6,120,678 A 9/2000 Stephenson et al.
6,159,442 A 12/2000 Thumm et al.
6,214,213 B1 4/2001 Tipman et al.
6,355,159 B1 3/2002 Myers et al.
6,358,403 B1 3/2002 Brown et al.
6,361,025 B1 3/2002 Cincotta et al.
6,391,190 B1 5/2002 Spence et al.
6,482,250 B1 11/2002 Williams et al.
6,497,813 B2 12/2002 Ackerson et al.
6,523,573 B2 2/2003 Robison et al.
6,566,410 B1 5/2003 Zaki et al.
6,746,599 B2 6/2004 Cymerman et al.
6,800,116 B2 10/2004 Stevens et al.
7,152,851 B2 12/2006 Cincotta
7,357,857 B2 4/2008 Hart et al.
7,569,137 B2 8/2009 Hyndman
7,690,445 B2 4/2010 Perez-Cordova
7,749,378 B2 7/2010 Iqbal et al.
7,820,031 B2 10/2010 D'Alessandro et al.
7,909,989 B2 3/2011 Duyvesteyn et al.
7,934,549 B2 5/2011 Cimolai
8,133,316 B2 3/2012 Poncelet et al.
8,141,636 B2 3/2012 Speirs et al.
8,147,682 B2 4/2012 Lahaie et al.
8,157,003 B2 4/2012 Hackett et al.
8,252,107 B2 8/2012 Esmaeili et al.
8,261,831 B2 9/2012 Lockhart et al.
8,262,865 B2 9/2012 Sharma et al.
8,312,928 B2 11/2012 Lockhart et al.

(56) References Cited

U.S. PATENT DOCUMENTS

| | | | | |
|---|---|---|---|---|
| 8,343,337 | B2 | 1/2013 | Moffett et al. | |
| 8,354,020 | B2 | 1/2013 | Sharma et al. | |
| 8,357,291 | B2 | 1/2013 | Sury et al. | |
| 8,382,976 | B2 | 2/2013 | Moran et al. | |
| 8,394,180 | B2 | 3/2013 | Diaz et al. | |
| 8,449,764 | B2 | 5/2013 | Chakrabarty et al. | |
| 8,454,821 | B2 | 6/2013 | Chakrabarty et al. | |
| 8,455,405 | B2 | 6/2013 | Chakrabarty | |
| 8,550,258 | B2 | 10/2013 | Bara et al. | |
| 8,585,891 | B2 | 11/2013 | Lourenco et al. | |
| 2002/0043579 | A1 | 4/2002 | Scheybeler | |
| 2003/0089636 | A1 | 5/2003 | Marchionna et al. | |
| 2004/0074845 | A1 | 4/2004 | Hagino et al. | |
| 2004/0256325 | A1 | 12/2004 | Frankiewicz | |
| 2005/0150816 | A1 | 7/2005 | Gaston | |
| 2005/0150844 | A1* | 7/2005 | Hyndman | C10G 1/045 210/750 |
| 2006/0065869 | A1 | 3/2006 | Chipman et al. | |
| 2006/0138055 | A1 | 6/2006 | Garner et al. | |
| 2006/0196812 | A1 | 9/2006 | Beetge et al. | |
| 2007/0125719 | A1 | 6/2007 | Yarbrough | |
| 2007/0180741 | A1 | 8/2007 | Bjornson et al. | |
| 2007/0284283 | A1 | 12/2007 | Duyvesteyn | |
| 2008/0000810 | A1 | 1/2008 | Garner et al. | |
| 2008/0185350 | A1 | 8/2008 | Remesat et al. | |
| 2008/0210602 | A1 | 9/2008 | Duyvesteyn | |
| 2009/0134059 | A1 | 5/2009 | Myers et al. | |
| 2009/0200210 | A1 | 8/2009 | Hommema | |
| 2009/0200688 | A1 | 8/2009 | Cincotta | |
| 2009/0294328 | A1 | 12/2009 | Iqbal | |
| 2009/0321322 | A1 | 12/2009 | Sharma | |
| 2009/0321324 | A1* | 12/2009 | Sharma | C10G 1/045 208/390 |
| 2010/0006474 | A1 | 1/2010 | Gaston et al. | |
| 2010/0076236 | A1 | 3/2010 | Van Heuzen et al. | |
| 2010/0078306 | A1 | 4/2010 | Alhazmy | |
| 2010/0089800 | A1 | 4/2010 | MacDonald et al. | |
| 2010/0096297 | A1 | 4/2010 | Stevens et al. | |
| 2010/0126395 | A1 | 5/2010 | Gauthier | |
| 2010/0126906 | A1 | 5/2010 | Sury | |
| 2010/0133149 | A1 | 6/2010 | O'Connor et al. | |
| 2010/0147516 | A1 | 6/2010 | Betzer-Zilevitch | |
| 2010/0155293 | A1 | 6/2010 | Verstraete et al. | |
| 2010/0155304 | A1 | 6/2010 | Ding et al. | |
| 2010/0206772 | A1 | 8/2010 | Keppers | |
| 2010/0243534 | A1 | 9/2010 | Ng et al. | |
| 2010/0258477 | A1 | 10/2010 | Kukkonen et al. | |
| 2010/0258478 | A1 | 10/2010 | Moran et al. | |
| 2010/0264068 | A1 | 10/2010 | Ikebe et al. | |
| 2010/0276341 | A1 | 11/2010 | Speirs et al. | |
| 2010/0276983 | A1 | 11/2010 | Dunn et al. | |
| 2010/0282642 | A1 | 11/2010 | Kan | |
| 2010/0298173 | A1 | 11/2010 | Smith et al. | |
| 2010/0320133 | A1 | 12/2010 | Page et al. | |
| 2011/0005750 | A1 | 1/2011 | Boerseth et al. | |
| 2011/0011769 | A1 | 1/2011 | Sutton et al. | |
| 2011/0061610 | A1 | 3/2011 | Speirs et al. | |
| 2011/0062090 | A1 | 3/2011 | Bara | |
| 2011/0089013 | A1 | 4/2011 | Sakurai et al. | |
| 2011/0100931 | A1 | 5/2011 | Lake et al. | |
| 2011/0127197 | A1 | 6/2011 | Blackbourn et al. | |
| 2011/0146164 | A1 | 6/2011 | Haney et al. | |
| 2011/0174683 | A1 | 7/2011 | Cui et al. | |
| 2011/0219680 | A1 | 9/2011 | Wilkomirsky Fuica | |
| 2011/0233115 | A1 | 9/2011 | Moran et al. | |
| 2011/0265558 | A1 | 11/2011 | Feimer et al. | |
| 2011/0284428 | A1 | 11/2011 | Adeyinka et al. | |
| 2012/0000830 | A1 | 1/2012 | Monaghan et al. | |
| 2012/0000831 | A1 | 1/2012 | Moran et al. | |
| 2012/0029259 | A1 | 2/2012 | McFarlane et al. | |
| 2012/0043178 | A1 | 2/2012 | Kan | |
| 2012/0074044 | A1 | 3/2012 | McFarlane | |
| 2012/0074045 | A1 | 3/2012 | Stauffer et al. | |
| 2012/0145604 | A1 | 6/2012 | Wen | |
| 2012/0175315 | A1 | 7/2012 | Revington et al. | |
| 2012/0217187 | A1 | 8/2012 | Sharma et al. | |
| 2012/0288419 | A1 | 11/2012 | Esmaeili et al. | |
| 2013/0043165 | A1 | 2/2013 | Revington et al. | |
| 2013/0081298 | A1 | 4/2013 | Bugg et al. | |
| 2013/0140249 | A1 | 6/2013 | Sury et al. | |
| 2013/0168294 | A1 | 7/2013 | Chakrabarty et al. | |
| 2013/0313886 | A1 | 11/2013 | Van Der Merwe et al. | |
| 2013/0345485 | A1 | 12/2013 | Duerr et al. | |
| 2014/0001101 | A1 | 1/2014 | Van Der Merwe et al. | |
| 2014/0011147 | A1 | 1/2014 | Van Der Merwe | |
| 2014/0048408 | A1 | 2/2014 | Van Der Merwe et al. | |
| 2014/0076785 | A1 | 3/2014 | Penner et al. | |
| 2014/0083911 | A1 | 3/2014 | Van Der Merwe et al. | |

FOREIGN PATENT DOCUMENTS

| | | | |
|---|---|---|---|
| CA | 1059052 | A1 | 7/1979 |
| CA | 1072474 | A1 | 2/1980 |
| CA | 1081641 | A1 | 7/1980 |
| CA | 1165712 | A1 | 4/1984 |
| CA | 1247550 | | 12/1988 |
| CA | 1249414 | A1 | 1/1989 |
| CA | 2075108 | A1 | 1/1994 |
| CA | 2123076 | A1 | 11/1995 |
| CA | 2165865 | A1 | 6/1997 |
| CA | 2174801 | | 10/1997 |
| CA | 2232929 | A1 | 9/1998 |
| CA | 2217300 | A1 | 3/1999 |
| CA | 2272045 | A1 | 11/2000 |
| CA | 2350001 | A1 | 12/2002 |
| CA | 2353109 | A1 | 1/2003 |
| CA | 2387257 | A1 | 11/2003 |
| CA | 2527058 | A1 | 3/2004 |
| CA | 2425840 | A1 | 10/2004 |
| CA | 2454942 | A1 | 7/2005 |
| CA | 2455011 | A1 | 7/2005 |
| CA | 2751587 | A1 | 7/2005 |
| CA | 2751773 | A1 | 7/2005 |
| CA | 2520943 | A1 | 4/2006 |
| CA | 2490734 | A1 | 6/2006 |
| CA | 2502329 | A1 | 9/2006 |
| CA | 2521248 | A1 | 3/2007 |
| CA | 2524110 | A1 | 4/2007 |
| CA | 2526336 | A1 | 5/2007 |
| CA | 2567185 | A1 | 4/2008 |
| CA | 2610122 | A1 | 5/2008 |
| CA | 2610124 | A1 | 5/2008 |
| CA | 2573633 | A1 | 7/2008 |
| CA | 2673961 | A1 | 7/2008 |
| CA | 2582059 | A1 | 9/2008 |
| CA | 2588043 | A1 | 11/2008 |
| CA | 2606312 | A1 | 4/2009 |
| CA | 2610052 | A1 | 5/2009 |
| CA | 2616036 | A1 | 6/2009 |
| CA | 2630392 | A1 | 11/2009 |
| CA | 2669059 | A1 | 12/2009 |
| CA | 2638120 | A1 | 1/2010 |
| CA | 2652355 | A1 | 8/2010 |
| CA | 2657360 | A1 | 9/2010 |
| CA | 2678818 | A1 | 3/2011 |
| CA | 2701317 | A1 | 3/2011 |
| CA | 2729457 | A1 | 7/2011 |
| CA | 2733862 | A1 | 7/2011 |
| CA | 2705055 | A1 | 11/2011 |
| CA | 2768852 | A1 | 11/2011 |
| CA | 2748477 | A1 | 3/2012 |
| CA | 2752558 | A1 | 3/2012 |
| CA | 2735311 | A1 | 9/2012 |
| GB | 587798 | A | 5/1947 |

OTHER PUBLICATIONS

Mitchell et al. "The solubility of asphaltenes in hydrocarbon solvents" Fuel, 1973, N. 02, vol. 52, p. 149-152.

Kemp, "Pinch Analysis and Process Integration, A User Guide on Process Integration for the Efficient Use of Energy", Second edition, Elsevier 2007.

(56) References Cited

OTHER PUBLICATIONS

Svreck et al "Successfully Specify Three-Phase Separators" Chemical Engineering Progress, Sep. 1994, p. 29-40.
Svreck et al. "Design Two-Phase Separators within the Right Limits" Chemical Engineering Progress, Oct. 1993, p. 53-60.
Fu et al."New technique for determination of diffusivities of volatile hydrocarbons in semi-solid bitumen", Fuel, 1979, vol. 58, August, pp. 557-560.
Kamoun et al."High Speed Shadowgraphy Investigations of Superheated Liquid Jet Atomization", ILASS-Americas 22nd Annual Conference on Liquid Atomization and Spray Systems, Cincinnati Ohio, May 2010.
Duan et al.'s "Numerical Analyses of Flashing Jet Structure and Droplet Size Characteristics" Journal of Nuclear Science and Technology, 2006, vol. 43, No. 3, p. 285-294.
Sou et al., "Effects of Cavitation in a Nozzle on liquid Jet atomization" International Journal of Heat and Mass Transfer; vol. 50, p. 3575-3582, 2007.
Ransom et al., "The relaps choke flow model and application to a large scale flow test", The American Society of Mechanical Engineers, Heat Transfer Division, 1980, Saratoga, New York.
Power,"Froth Treatment: Past, Present &Future" Oil Sand Symposium, University of Alberta, May 3-5, 2004.
Rahmani, "Shear-Induced Growth of Asphaltene Aggregates" Oil Sand Symposium, University of Alberta, May 4, 2004.
Paul et al. "Handbook of Industrial Mixing: Science and Practice" Wiley Interscience 2004, p. 391-477.
Blevins "Applied fluid dynamics handbook", Van Nostrand Reinhold Company 1984, p. 80-83.
Wu et al., "Experimental study on steam plume and temperature distribution for sonic jet" J. Phys.: Conf.Ser. 147 2009, 012079.
Yeon et al., "An Experimental Investigation of Direct Condensation of Steam Jet in Subcooled Water" Journal of Korean Nuclear Society vol. 29, No. 1, pp. 45-57, Feb. 1997.
Long et al., "Structure of water/solids/asphaltenes aggregates and effect of mixing temperature on settling rate in solvent-diluted bitumen" Fuel 2004, vol. 83, p. 823-832.
Rahimi et al., "Partial Upgrading of Athabasca Bitumen Froth by Asphaltene Removal", Unitar International Conference on Heavy Crude and Tar Sande, No. 1998.074, p. 1-8.
Hoehenberger, "Water Treatment, Cycle Chemistry, Boiler Operation and Related Problems/Failures on Steam Generator Systems > 30 bar", TÜSÜD Industry Services, 2006, p. 1-14.
Schroyer, "Understand the Basics of Steam Injection Heating", Chemical Engineering Progress, Hydro-Thermal Corporation, May 1997, p. 1-4.
Prosonix, "PSX Steam Jet Diffuser . . . Technology That Makes a Difference", PSX Jet Diffuser 20110209.
Prosonix, "ProSonix Technical Bulletin", TB-4 Liquid & Steam Pressure Relationship.
Prosonix, "PSX Technical Bulletin", TB-7 Internally Modulated Steam Control 0210.
Prosonix, "Sparging Efficiency vs. Direct Steam Injection", TB-6 Sparging Efficiency & Performance 20101210.
Siemens, "Pictures of the Future", Spring 2006, Power Plants—Siemens Global Website, http://www.siemens.com/innovation/en/publikationen/publications_pof/pof_spring_2006/infrastructures_articles/power_plants.htm.
George, "Mining for Oil", Scientific American, Mar. 1998, p. 84-85.
Speight, "Deasphalting and Dewaxing Processes", The Chemistry and Technology of Petroleum, Fourth Edition, Chapter 19, CRC Press 2006.
Jeribi et al., "Adsorption Kinetics of Asphaltenes at Liquid Interfaces", Journal of Colloid and Interface Science, vol. 256, Issue 2, Dec. 15, 2002, pp. 268-272.
Branan, "Pocket Guide to Chemical Engineering" Elsevier Science & Technology Books, Nov. 1999.
Perry, "Perry's Chemical Engineers' Handbook" (7th Ed.), 1997.
Clarke et al., "Asphaltenes precipitation from Cold Lake and Athabasca bitumens", Petroleum Science and Technology, 1998, 16:3-4, p. 287-305.
Al-Atar, "Effect of Oil Compatibility and Resins/Asphaltenes Ratio on Heat Exchanger Fouling of Mixtures Containing Heavy Oil", Master Degree Thesis report, The University of British Columbia, Feb. 2000.
Gearhart, "Rose® process offers energy savings for solvent extraction", Proceedings from the Fifth Industrial Energy Technology Conference vol. II, Houston, TX, Apr. 17-20, 1983, p. 823-835.
Clarke et al., "Asphaltene precipitation: detection using heat transfer analysis, and inhibition using chemical additives" Fuel, vol. 76, Issue 7, May 1997, p. 607-614.
Shell Canada Limited, Application for Approval of the Jackpine Mine—Phase 1, ERCB application No. 1271285, May 2002.
Imperial Oil Ressources Ventures Limited, Application for the Imperial Oil Resources Ventures Limited (Imperial Oil) and ExxonMobil Canada Properties (ExxonMobil Canada) Kearl Oil Sands Project—Mine Development (Kearl Project), ERCB Application No. 1408771, Jul. 12, 2005.
Shell Canada Limited, Application for the Approval of Muskeg River Mine Project, ERCB Application No. 970588, Dec. 19, 1997.
Beckman Coulter, Particle Size and Size Distribution Analysis, Coulter Counter.com, pp. 1-3.
Outokumpu Technology, Slurry particle size analyzer, PSI 200 TM, 2006, pp. 1-8.
Johnson, Particle size distribution in clays, Clays and Clay Minerals, pp. 89-91.
Buckley et al., Solubility of the Least-Soluble Asphaltenes, Asphaltenes, Heavy Oils, and Petroleomics, Springer, 2007, Chapter 16, pp. 401-437.
Gerson et al., The Relation of Surfactant Properties to the Extraction of Bitumen from Athabasca Tar Sand by a Solvent-Aqueous-Surfactant Process, Chemistry for Energy, American Chemical Society, 1979, Chapter 6, pp. 66-79.
Nour et al., Characterization and Demulsification of Water-in-crude Oil Emulsions, Journal of Applied Sciences, vol. 7, issue 10, 2007, pp. 1437-1441.
Malcolmson et al., In-Line Particle Size Measurements for Cement and Other Abrasive Process Environments, for Presentation at the IEEE/PCA 40th Cement Industry Technical Conference, 1998, pp. 1-13.
International Search Report and Written Opinion for PCT/PCT/CA2012/050247 dated Jul. 10, 2010.
William L. Luyben, "Heat-Exchanger Bypass Control", Ind. Eng. Chem. Res. 2011, 50, 965-973.
Dutta-B, "Principles of Mass Transfer and Separation Processes", p. 344, 2009.
Schaschke, Carl. (2014). Dictionary of Chemical Engineering. Oxford University Press. p. 67. Online version available at:http://app.knovel.com/hotlink/toc/id:kpDCE00021/dictionary-chemical-engineering/dictionary-chemical-engineering.
Imran Ali, "Process Heating by Direct Steam Injection", Pharmaceutical Guide; Dec. 2010.
Choung, J. et al., "Effect of Temperature on the Stability of Froth Formed in the Recycle Process Water of Oil Sands Extraction", The Canadian Journal of Chemical Engineering, vol. 82, Aug. 2004, pp. 801-806.
Wiwchar, K. et al., "Column flotation in an oilsand application", Proceedings 36th Annual Meeting of the Canadian Mineral Processors, Ottawa, Ontario, Canada, Jan. 20-22, 2004.
Cleyle, P. et al., "Column Flotation Testing at Suncor Energy Inc.", Oilsand 2006 Conference, CD, University of Alberta, Feb. 22-24, 2006.
Finch, J. et al. "Column Flotation", 1st ed. Pergamon Press, 1990, pp. 1-7, 75-79, 82-89, 148-149, 152-159.
Baczek, "Paste Thickening Design Evolving to Higher Capacities and Efficiencies", International Minimizing Supplement to Paste Tailing Management, Mar. 2007. 16 pages.
Versteeg et al., "An Introduction to Computational Fluid Dynamics: the Finite Volume Method", 2nd Edition, Pearson Prentice Hall, First published 1995 and 2nd Edition published 2007, pp. 9, 33-77, 88-97, 78-87, 98-114, 115, 131-133, 156-164, 186-196, 256-264.

(56) References Cited

OTHER PUBLICATIONS

Ferziger et al., "Computational Methods for Fluid Dynamics", 3rd Edition, Springer, 2002, pp. 142-151, 188-206, 226-245, 265-307, 324-328.
Hobbs, D.M., "Optimization of a static mixer using dynamical systems techniques", published 1998, Elsevier Science, Chemical Engineering, vol. 53, No. 18, pp. 3199-3213.
Godard, et al., "A Review of Suncor Energy's Millennium Extraction Process", Proceedings 36th Annual Meeting of the Canadian Mineral Processors, pp. 141-152 (2004).
Mankowski et al., "Syncrude's Low Energy Extraction Process: Commercial Implementation", Proceedings 31st Annual Meeting of the Canadian Mineral Processors, pp. 154-181 (1999).
"Choked Flow of Gases", O'Keefe Controls Co., pp. 38, 16-18 (2000).

* cited by examiner

ENHANCED TURNDOWN PROCESS FOR A BITUMEN FROTH TREATMENT OPERATION

FIELD OF THE INVENTION

The present invention generally relates to the field of bitumen froth treatment operations and more particularly to enhanced processes with turndown functionality.

BACKGROUND

Bitumen froth treatment plants historically have been designed for a given froth feed flow despite the fact that the actual flow varies significantly in response to oil sand grade variation and upstream equipment availability. Variations in feed flow, composition and temperature can result in several challenges that affect recovery and unit reliability.

Conventional solutions to variable froth flow are to coordinate start up and shut down of froth treatment operations with upstream unit operations.

In addition to the significant coordination effort related to the displacement of oil sand to ore preparation sites as well as the logistics of supplying utilities for ore preparation, bitumen extraction and tailings disposal, there are significant time delays associated with obtaining stability for each unit operation. An upset in any one unit can directly impact the production chain.

Oil sand operations are characterized by oil sand grade variations. The grade variations of the oil sand ore often range between approximately 7 wt % and 15 wt % bitumen, which is typically blended in mine and preparation operations to a narrower range between approximately 10.5 wt % and 12 wt %. This blending is dependant on equipment availability.

For some previous naphthenic froth treatment operations, dilution centrifuges were provided in parallel, the on/off operation of which permitted a range of process turndown options to adjust to froth supply variations. However, in paraffinic froth treatment operations, the large separation vessels that are used are sensitive to feed variations and upsets can interrupt efficiency of the production chain.

There is a need for a technology that overcomes at least some of the disadvantages or inefficiencies of known techniques.

SUMMARY OF THE INVENTION

The present invention responds to the above need by providing a process for enhanced turndown in a bitumen froth treatment operation.

The invention provides a process for operating a bitumen froth treatment operation in turndown mode, comprising:

adding a solvent containing stream to bitumen froth to produce diluted bitumen froth;

separating the diluted bitumen froth into a diluted bitumen component and a solvent diluted tailings component; and in response to a reduction in flow of the bitumen froth:

recirculating a portion of the diluted bitumen component into the bitumen froth as a recirculated dilbit component; and returning a portion of the solvent diluted tailings component into the step of separating as a returned solvent diluted tailings component.

In one optional aspect, the step of separating is performed in a separation apparatus comprising:

a first stage separation vessel receiving the diluted bitumen froth and producing the diluted bitumen component and a first stage underflow component; and a second stage separation vessel receiving the first stage underflow component and producing the solvent diluted tailings components and a second stage overflow component.

In another optional aspect, the first and second stage separation vessels are gravity settlers.

In another optional aspect, the process includes returning a portion of the first stage underflow component into the first stage separation vessel.

In another optional aspect, the process includes returning a portion of the second stage underflow component into the second stage separation vessel.

In another optional aspect, the process includes recirculating a portion of the first stage overflow component into the bitumen froth.

In another optional aspect, the process includes recirculating a portion of the second stage overflow component into the first stage underflow.

In another optional aspect, the solvent containing stream added to the bitumen froth comprises at least a portion of the second stage overflow component.

In another optional aspect, the process includes heating the second stage overflow component prior to using as the solvent containing stream.

In another optional aspect, the process includes adding a second stage solvent containing stream to the first stage underflow component.

In another optional aspect, the second stage solvent containing stream consists essentially of solvent.

In another optional aspect, the process includes subjecting the first stage underflow component and the second stage solvent containing stream to mixing to produce a diluted first stage underflow for introduction into the second stage separation vessel.

In another optional aspect, the process includes subjecting the bitumen froth and the solvent containing stream to mixing to produce the diluted bitumen froth.

In another optional aspect, the process includes preheating the bitumen froth to produce heated bitumen froth prior to adding the solvent containing stream thereto.

In another optional aspect, the pre-heating is performed by direct steam injection into the bitumen froth.

In another optional aspect, the process includes recirculating a portion of the heated bitumen froth back into the bitumen froth upstream of the pre-heating.

In another optional aspect, the process includes tanking the heated bitumen froth prior to pumping the heated bitumen froth to the step adding of the solvent containing stream thereto.

In another optional aspect, the process includes regulating the flows of the recirculated dilbit component and the returned solvent diluted tailings component in response to the flow of the bitumen froth.

In another optional aspect, the step of separating is performed in a separation apparatus comprising:

a first stage separation vessel receiving the diluted bitumen froth and producing the diluted bitumen component and a first stage underflow component;

an addition line for adding make-up solvent to the first stage underflow component to produce a diluted first stage underflow component; and a second stage separation vessel receiving the diluted first stage underflow component and producing the solvent diluted tailings components and a second stage overflow component; and the process also includes:

recirculating a portion of the first stage overflow component into the bitumen froth as a dilbit recirculation stream;

returning a portion of the first stage underflow component into the first stage separation vessel as a first stage return stream;

recirculating a portion of the second stage overflow component into the first stage underflow as a second stage recirculation stream; and returning a portion of the second stage underflow component into the second stage separation vessel as a second stage return stream.

In another optional aspect, sub-steps (a), (b), (c) and (d) are initiated sequentially.

In another optional aspect, in sub-step (a) the dilbit recirculation stream is provided with a flow corresponding to the reduction in the flow of the bitumen froth.

In another optional aspect, in sub-step (b) the first stage return stream is returned below an hydrocarbon-water interface within the first stage separation vessel.

In another optional aspect, in sub-step (b) the first stage return stream is returned to provide a velocity of the first stage underflow component sufficient to avoid solids settling and asphaltene mat formation.

In another optional aspect, in sub-step (c) the second stage recirculation stream is provided with a flow corresponding to the reduction in flow of the first stage underflow component due to the first stage return stream.

In another optional aspect, in sub-step (d) the second stage return stream is returned below an hydrocarbon-water interface within the second stage separation vessel.

In another optional aspect, in sub-step (d) the second stage return stream is returned to provide a velocity of the second stage underflow component sufficient to avoid solids settling and asphaltene mat formation.

In another optional aspect, sub-steps (a) and (c) are performed such that flows of the dilbit recirculation stream and the second stage recirculation stream are sufficient to avoid settling of solids in respective recirculation piping systems.

In another optional aspect, the process also includes sub-step (e) of recycling a portion of the bitumen froth back upstream.

In another optional aspect, step (e) is initiated in response to an additional reduction in the flow of the bitumen from below a given flow value.

In another optional aspect, the given flow value corresponds to a minimum pump requirement flow for pumping the bitumen froth.

In another optional aspect, the process also includes two parallel trains each comprising at least one of the separation apparatus.

In another optional aspect, the separation apparatus is sized and configured to allow full standby mode.

In another optional aspect, the bitumen froth treatment operation is a paraffinic froth treatment operation and the solvent is paraffinic solvent.

In another optional aspect, the bitumen froth treatment operation is a naphthenic froth treatment operation and the solvent is naphthenic solvent.

In another optional aspect, the process also includes following a control strategy comprising flow control of the bitumen froth, the diluted bitumen component, the first stage underflow component, the second stage overflow component and the solvent diluted tailings component and the make-up solvent to maintain material balance.

In another optional aspect, the control strategy comprises acquiring flow measurements of hydrocarbon-rich streams.

In another optional aspect, the control strategy comprises acquiring measurements of solvent, bitumen, water and/or mineral content in the solvent diluted froth or the diluted first stage underflow component.

In another optional aspect, the control strategy comprises solvent-to-bitumen ratio (S/B) control.

In another optional aspect, the S/B control comprises designating a master stream relative to a slave stream in terms of the S/B.

In another optional aspect, the S/B control comprises designating a master stream relative to a slave stream.

In another optional aspect, the control strategy comprises level control of bitumen froth in a froth tank, first stage separation vessel overflow, first stage separation vessel water-hydrocarbon interface, second stage separation vessel overflow and second stage separation vessel water-hydrocarbon interface.

In another optional aspect, the level control comprises adjusting pump speed, adjusting pump discharge valve or adjusting pump bypass recirculation valve or a combination thereof to maintain a stable level.

In another optional aspect, the process includes controlling the S/B ratio in the diluted froth stream.

In another optional aspect, the process also includes following a control strategy comprising flow control of the bitumen froth, the diluted bitumen component, the solvent diluted tailings component, and the solvent, to maintain material balance.

In another embodiment, the invention provides method for turndown of a froth separation vessel for treating a bitumen froth with addition of a paraffinic solvent to produce a solvent diluted bitumen froth with a solvent-to-bitumen ratio, the froth separation vessel separating the solvent diluted bitumen froth provided at a feed flow into a diluted bitumen component and a solvent diluted tailings underflow component, wherein in response to a reduction in flow of the bitumen froth, the method comprises:

sustaining the feed flow to the froth separation vessel;

maintaining the solvent-to-bitumen ratio in the diluted bitumen froth; and retaining water, minerals and asphaltenes in a lower section of the froth separation vessel while sustaining an outlet flow of the solvent diluted tailings underflow component from the froth separation vessel to provide sufficient velocities to avoid solids and asphaltene clogging.

In an optional aspect, step (i) comprises recirculating a portion of the diluted bitumen component back into the bitumen froth.

In another optional aspect, step (ii) comprises reducing the amount of the solvent added to the bitumen froth.

In another optional aspect, step (ii) comprises recirculating a portion of the diluted bitumen component back into the bitumen froth.

In another optional aspect, step (iii) comprises returning a portion of the solvent diluted tailings back into the froth separation vessel below a hydrocarbon-water interface.

In another optional aspect, the froth separation vessel comprises:

a first stage separation vessel receiving the diluted bitumen froth and producing the diluted bitumen component and a first stage underflow component;

an addition line for adding make-up solvent to the first stage underflow component to produce a diluted first stage underflow component; and a second stage separation vessel receiving the diluted first stage underflow component and producing the solvent diluted tailings components and a second stage overflow component; and the method includes:

recirculating a portion of the first stage overflow component into the bitumen froth as a dilbit recirculation stream to sustain the feed flow to the first stage separation vessel;

returning a portion of the first stage underflow component into the first stage separation vessel as a first stage return stream;

recirculating a portion of the second stage overflow component into the first stage underflow as a second stage recirculation stream to sustain the feed flow to the second stage separation vessel; and returning a portion of the second stage underflow component into the second stage separation vessel as a second stage return stream.

In another optional aspect, the method includes sub-step (e) of recycling a portion of the bitumen froth back upstream.

In another optional aspect, step (e) is initiated in response to an additional reduction in the flow of the bitumen from below a given flow value.

In another optional aspect, the given flow value corresponds to a minimum pump requirement flow for pumping the bitumen froth.

In another optional aspect, the method includes two parallel trains each comprising at least one of the froth separation vessel.

In another optional aspect, the separation apparatus is sized and configured to allow full standby mode.

In another optional aspect, the method includes following a control strategy comprising flow control of the bitumen froth, the diluted bitumen component, the solvent diluted tailings component and the solvent, to maintain material balance.

In another embodiment, the invention provides a process for operating a bitumen froth treatment operation, comprising:

adding a solvent containing stream to bitumen froth to produce diluted bitumen froth;

separating the diluted bitumen froth into a diluted bitumen component and a solvent diluted tailings component; and using a portion of the diluted bitumen component as a viscosity modifying agent of the bitumen froth.

In one aspect, this process may be associated or have steps or features of the previously described method or process.

The invention also provides a use of diluted bitumen derived from a paraffinic froth treatment comprising adding a solvent containing stream to bitumen froth to produce diluted bitumen froth and separating the diluted bitumen froth into the diluted bitumen and a solvent diluted tailings component, as a viscosity modifying agent of the bitumen froth.

In one aspect, the diluted bitumen is at saturation with respect to asphaltenes. A portion of the diluted bitumen may be recycled into the bitumen froth upstream of mixing of the bitumen froth and the solvent containing stream. The diluted bitumen may preferably avoid increasing asphaltene precipitation from the bitumen froth. The diluted bitumen may reduce solvent-to-bitumen ratio in the diluted bitumen froth to promote solubility stability.

DETAILED DESCRIPTION

According to embodiments of the present invention, a froth separation apparatus is able to turn down to a recirculation mode in response to variations in froth feed supply. The process allows the ability to respond to froth feed supply variation, to commission and shut down froth treatment processing equipment independent of froth supply and design smaller and more cost efficient froth treatment equipment such as separation vessels.

Figure 1:
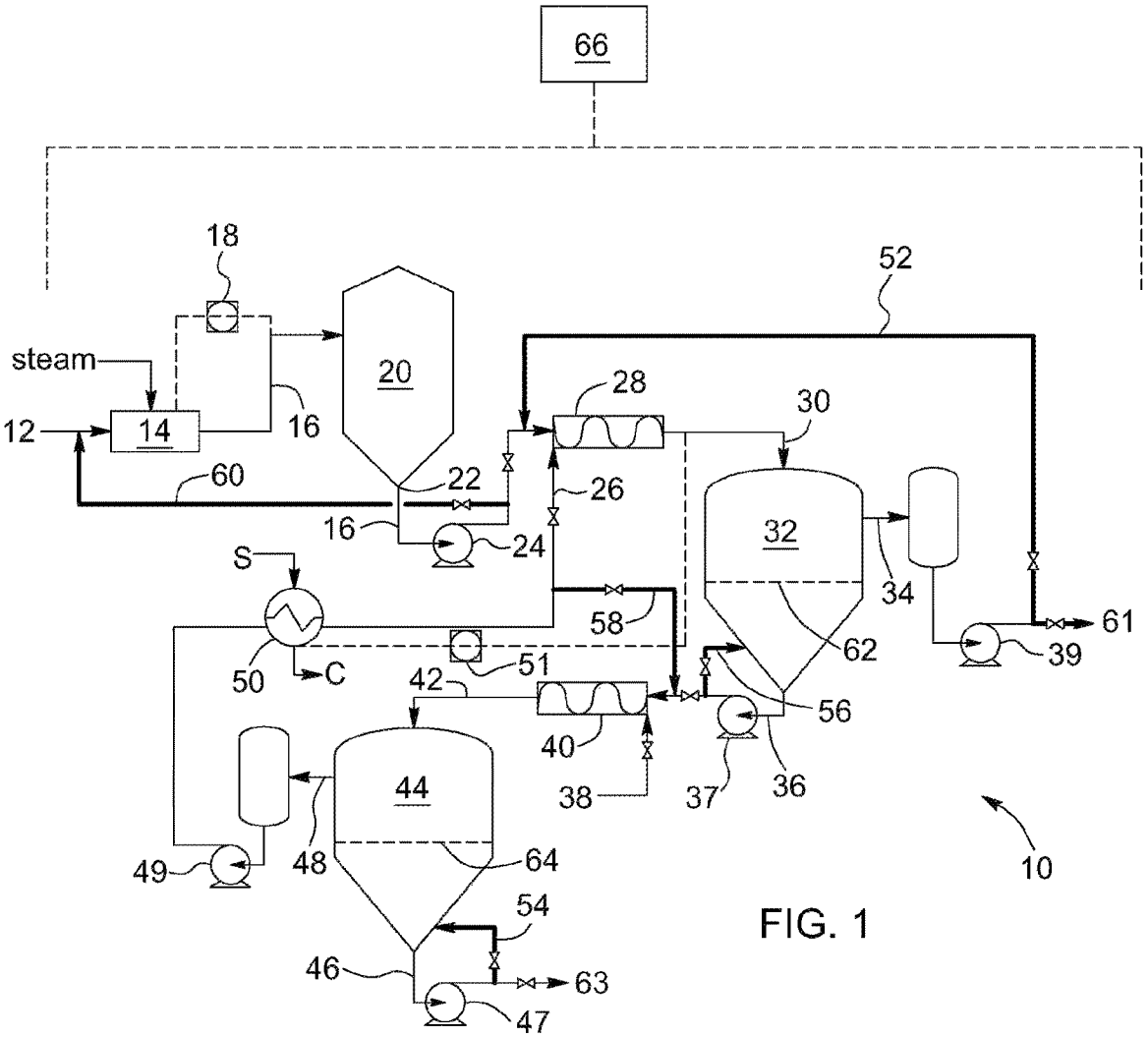
FIG. 1 is a process flow diagram of a two stage froth separation unit, with recirculation lines in bold, according to an embodiment of the present invention.

Referring to FIG. 1, a froth separation unit (FSU) 10 is illustrated. In standard operating mode, the FSU 10 receiving bitumen froth 12 from a primary separation vessel (not illustrated) which separates oil sand ore slurry into an overflow of bitumen froth, middlings and an underflow comprising coarse tailings. The oil sand ore slurry has a composition dependant on the slurry preparation operation as well as the geological body from which the ore was obtained. Thus, the oil sand ore slurry and, in turn, the bitumen froth may vary in composition and flow rate. These variations may occur gradually or as a step change, often reflecting the nature of the oil sand ore body. The variations may also derive from upstream unit operation upsets in oil sand mining and extraction operations. It should also be noted that the bitumen froth, rather than coming from an oil sands mining and extraction operation, may be derived from an in situ heavy hydrocarbon operation. In situ operations involve subterranean wells located in bitumen containing reservoirs and use heat, steam, hot water, solvent or various combinations thereof to mobilize the bitumen so that it can be withdrawn through a production well. One well known in situ operation is called steam assisted gravity drainage (SAGD). In situ bitumen containing streams may be subjected to bitumen froth treatment, preferably paraffinic froth treatment (PFT) to improve bitumen quality by reducing asphaltene content.

Referring still to FIG. 1, the bitumen froth 12 is supplied to the FSU 10 and preferably to a froth heater 14. The froth heater 14 may include one or more heaters in parallel and/or series to produce a heated bitumen froth 16. In one aspect, the heater 14 may be a direct steam injection heater and heating may be performed as described in Canadian patent application No. 2,735,311. The temperature of the heated bitumen froth 16 may be controlled via a heating controller 18 coupled to the heated bitumen froth and the heater 14.

The heated bitumen froth may be held in a froth tank 20 a bottom outlet 22 of which is coupled to a froth pump 24. The froth pump 24 supplies the heated froth 16 under pressure.

A solvent containing stream 26 is added to the heated bitumen froth 14. There may be a mixer 28 provided immediately downstream or as part of the addition point of the solvent containing stream 26. The mixer may include one or more mixers in parallel and/or series to help produce a diluted bitumen froth 30. The mixer may be designed, constructed, configured and operated as described in Canadian patent application No. 2,733,862. As will be described in greater detailed herein-below, the solvent containing stream is preferably an overflow stream from a downstream separation vessel, but it could also at least partially consist of fresh or make-up solvent.

Still referring to FIG. 1, the diluted bitumen froth is supplied as feed to a froth separation apparatus. Preferably, the froth separation apparatus comprises two counter-current froth separation vessels which may be gravity separation vessels. More particularly, the diluted bitumen froth 30 is fed to a first stage separation vessel 32 and is separated into an overflow stream of diluted bitumen 34 (also referred to herein as "dilbit" 34) and a first stage underflow 36 which is solvent diluted. The first stage underflow 36 is withdrawn and pumped by a first stage underflow pump 37. The dilbit 34 is provided to an overflow pump 39.

A second solvent containing stream 38, which may be referred to as make-up solvent, is then added to the first stage underflow 36. There is a second stage mixer 40 provided immediately downstream or as part of the addition point of the second solvent containing stream 38. Thus the second solvent 38 can be added immediately upstream or concurrent with the mixer. Preferably, the second solvent containing stream 38 consists essentially of solvent, which has been recovered in a solvent recovery unit and a tailings solvent recovery unit from the dilbit and the solvent diluted tailings respectively. The mixer facilitates production of a diluted first stage underflow 42.

The diluted first stage underflow 42 is then fed to a second stage separation vessel 44 which produces a second stage underflow which is solvent diluted tailings 46 which is pumped by a second stage underflow pump 47 and a second stage overflow 48 which his pumped by a second stage overflow pump 49. The second stage overflow 48 preferably contains sufficiently high content of solvent that it is used as the solvent containing stream 26 for addition into the heated bitumen froth 16. In one aspect, the second stage overflow 48 is heated in a second stage heater 50, also referred to as a "trim heater" receiving steam S and producing condensate C, prior to addition into the heated bitumen froth 16. The temperature of the bitumen froth feed 30 may be controlled via a heating controller 51 coupled to the second stage heater 50.

Still referring to FIG. 1, a recirculation system is provided in order to facilitate operating the froth treatment unit from a standard mode to a turndown mode. In a broad sense, the recirculation system preferably includes a recirculated dilbit component 52 and a returned solvent diluted tailings component 54, whether the separation apparatus includes one, two or more separation vessels. More particularly, the recirculation system preferably includes a first stage recirculated dilbit component 52 which is recirculated back into the heated bitumen froth 16, a returned first stage underflow component 56 which is returned into the first stage separation vessel 32, a recirculated second stage overflow component 58 which is recirculated back into the first stage underflow component 56 preferably downstream of the returned first stage underflow component 56, and a returned second stage underflow component of solvent diluted tailings 54 which is returner into the second stage separation vessel 44. The system may also include a recirculated bitumen froth component 60 which is recirculated back into the bitumen froth 12.

The recirculated bitumen froth component 60 may also be referred to as "froth recirc", the recirculated dilbit component 52 may also be referred to as "1$^{st}$ stage O/F recirc", the returned first stage underflow component 56 may also be referred to as "1$^{st}$ stage U/F recirc", the recirculated second stage overflow component 58 may also be referred to as "2$^{nd}$ stage O/F recirc", and the returned second stage underflow component 54 may also be referred to as "2$^{nd}$ stage underflow recirc".

In standard operating mode of the froth treatment unit, the recirculation and return lines illustrated bold in FIG. 1 may be closed, though it should be understood that one or more of the lines may be partially open in order to keep fluid flow therethrough to reduce stagnation or fouling therein or for other process control purposes.

In one preferred aspect of the present invention, in the standard operating mode of the froth treatment unit, flow control either by direct flow measurement or inferred by calculation methods represents the primary control of key process variables (PV) which include the flow of bitumen froth 16, 1$^{st}$ stage O/F 34, 1$^{st}$ stage U/F 36, make-up solvent 38, 2$^{nd}$ stage O/F 48 and 2$^{nd}$ stage U/F 46, to maintain the process material balance. Preferably, the flow measurement selected by the control system reflects measurement reliability. For example, flow measurement of hydrocarbon or hydrocarbon-rich streams such as settler O/F is considered relatively reliable when compared to flow metering on streams such as froth or U/F. This measurement reliability combined with inline measurements of solvent, bitumen, water and mineral in diluted froth or diluted underflow streams can either allow inference or correction of erroneous froth or underflow measurements used by the control system. It is also noted that the relative volumes of the froth tank 20, the 1$^{st}$ stage O/F 22, and the 2$^{nd}$ stage O/F cause analytical measurements of bitumen, solvent, water and mineral to respond relatively slowly when compared to flow sensors which quickly sense step changes from a process turn down. The analytical measurements can be online or routine samples for off line analysis.

In addition to the key flow process variables, flow controls coupled with inline analytical measurements permit the derivation and control of key process ratios such as S/B. Designating one stream as the master stream, relative to another stream as a slave (SP) allows maintaining key process ratios to the master stream that will be illustrated in an example and permits stable turndown of operation to a froth feed interruption. By quickly adjusting flows to maintain key ratios, analytical measurement delays are mitigated and are not critical. In one preferred aspect, the flow is adjusted and the analytical measurements are used as confirmations or time averaged updates or the like.

Referring to FIG. 1, it should also be noted that all key process variables in the froth treatment process may be transferred by pumps except for make-up solvent 38 which may be supplied by valve control from the make-up solvent system. Pumps are selected for specific head-flow capacity characteristics at a specific pump speed reflecting the requirements of the process material balance which at steady state is reflected by the associated process pump maintaining consistent levels in froth tank 20, 1$^{st}$ stage separator O/F vessel, 1$^{st}$ stage separator interface 62, 2$^{nd}$ stage separator O/F vessel and the 2$^{nd}$ stage separator interface 64. Variations in the material balance are reflected in level variations in the vessels and by either adjusting pump speed or pump discharge valve or pump bypass recirculation valve changes the flow through a pump to maintain a stable level. In the event the flow through a pump is below a specific value, either minimum flow provisions are needed to protect the pump from over heating or the pump is shut down.

In addition, it should be noted as illustrated in FIG. 1, that the direct froth heaters 14 and the $2^{nd}$ stage O/F heater 50 use steam to heat the process stream or fuel gas in fired heaters with stable turndown over the operating range. As both the froth heater 14 and to $2^{nd}$ stage O/F heater 50 maintain the process temperature of the associated froth and $2^{nd}$ stage O/F, the energy supply flow has a slave response to changes in froth or $2^{nd}$ stage O/F flows. Temperature control of those streams may be set up according to achieve desired heating, mixing and separation performance.

In turndown operating mode of the froth treatment unit, the recirculation and return lines are opened as illustrated in FIG. 1. It should be noted that the recirculation and return lines may be opened according to a variety of methodologies depending on a number of operating parameters, such as operable S/B range, pressures, temperatures, flow rates, FSU setup (e.g. single or parallel trains), magnitude and rate of flow upset, type of flow upset (e.g. step change or impulse change), turndown rate, etc.

In one preferred aspect, the system is configured and process operated to respond to a step change in froth flow. In response to a step change, the recirculation system opens line 52, 56, 58 and 54 in a sequential order, as will be further understood from the description herein-below. In addition, the recirculation system is preferably managed and controlled in accordance with a desired S/B ratio for the given temperature and pressure conditions of the FSU and a consistent flow to each of the first and second stage mixers and separation vessels 32, 44. From a high-level operating standpoint, the process is operated so that a reduction of bitumen froth 12 flow results in a corresponding reduction in produced dilbit 61, produced solvent diluted tailings 63 and fresh solvent 38, while generally maintaining the flow of the streams that remain within the system. The process may include the following recirculation methodologies:

First, in response to a step change reduction in bitumen froth 12 flow, the dilbit recirculation 52 is initiated. The dilbit recirculation 52 may be provided, managed or controlled to essentially compensate for the difference in reduced froth flow to maintain the efficiency of the mixer 28 and separation in the first stage separation vessel 32. The froth pump 24 would continue to provide a flow of heated froth which is mixed with the $2^{nd}$ stage O/F 26 and the dilbit recirculation 52 would maintain a generally constant flow of diluted bitumen froth 30 to the first stage separation vessel 32, and circulate a generally constant flow of high diluted bitumen 34 to the $1^{st}$ stage O/F pump 39.

If froth 12 flow supplied to the FSU is reduced below the minimum froth pump requirement, an additional turndown strategy may be adopted. More particularly, the pump can continue to operate at its minimum flow requirement, but a portion of the pumped froth is recycled by opening the froth recirculation line 60. This will therefore reduce the amount of froth being provided to the mixer 28 and separation vessel 32 and, consequently, the dilbit recirculation 52 flow is preferably increased to compensate for this additional reduction is froth flow, again to maintain a consistent fluid flow through the mixer 28 to the separation vessel 32.

Increasing the dilbit recirculation 52 flow allows consistent first stage mixing and separation performance and also causes some changes within the first stage separation vessel 32. The amount of water and mineral in the incoming diluted froth stream 30 decreases and thus the hydrocarbon-water interface 62 within the settler 32 moves downward. The lower water/minerals phase is reduced and replaced by a larger upper hydrocarbon phase. It is desirable to keep the velocity of the water/minerals phase within the vessel 32 and its underflow outlet sufficiently high so as to avoid various settling and plugging issues. For instance, mineral solids can settle out of the phase if the velocities fall below a critical settling value. In addition, in the case of paraffinic froth treatment (PFT), in which asphaltenes are precipitated out with the water/mineral bottom phase, it is also desirable to keep the lower phase and underflow at a velocity sufficient to avoid formation and deposition of asphaltene mats which are difficult to break-up, clean and remove. Consequently, the first stage underflow recirculation 56 may be engaged in response to an underflow velocity set point and/or a hydrocarbon-water interface 62 level in the settler 32. The underflow recirculation may also be dependent on or controlled by the minimum flow requirement of the underflow pump 37. This $1^{st}$ stage U/F recirculation maintains water/minerals and asphaltenes in the lower section of the settler 32 avoiding solids packing and plugging settler underflow outlets which risk occurring at low flow rates. The $1^{st}$ stage U/F recirculation also facilitates maintaining the first underflow pump 37 above minimum flow rate and avoiding of settling in the settler 32 at low flows.

Initiating the first stage underflow recirculation 56, in turn, causes a reduction in the second stage feed flow. In response to the reduced first stage underflow flow provided to the second stage, the second stage overflow recirculation 58 may be engaged. Preferably and similarly to the first stage overflow recirculation 52, the second stage overflow recirculation 58 is provided to compensate for the reduction of first stage underflow 36 lost to its own recirculation 56.

The second stage overflow recirculation 58 contains a high concentration of solvent and thus the fresh solvent 38 flow may be decreased. It is also noted that a reduction in bitumen froth 12 leads to a corresponding reduction in solvent 38 demands.

By increasing the second stage overflow recirculation 58, the more solvent and bitumen is contained in the second stage feed stream 42 and, in turn, the relative proportions of hydrocarbon and water/minerals phases will change in the second stage separation vessel 44. A second stage hydrocarbon-water interface 64 separating the phase moves down as more hydrocarbons are present in the vessel 44. Similarly to the first stage, the second stage underflow recycle 54 is engaged to ensure that the lower water/minerals phase, which may also contain significant amounts of asphaltenes in certain embodiments, maintain a velocity to avoid clogging, plugging and asphaltene mat formation issues.

Once the transition to turndown mode is complete, the FSU may operate smoothly with constant stream flows until ready to transition back to standard operating mode.

In turndown mode, portions of the first and second stage overflow streams recirculate back as respective first and second stage feed supplies. This maintains stable feed flows to each of the froth separation vessels while facilitating unit turndown mode by replacing feed from upstream operation. The $1^{st}$ and $2^{nd}$ stage O/F recirculation further facilitates maintaining feed to respective FSVs at velocities at or above minimum velocities to avoid settling of solids in the respective pipe systems.

In turndown mode, portions of the first and second stage underflows are recycled back into the lower section of the respective first and second stage froth separation vessels (FSVs).

A control system 66 facilitates the recirculation controllers to automatically transition the unit operation and minimize operator intervention and associated risk of error.

According to an embodiment of the present invention, the recirculation system of the froth separation unit process streams facilitates commissioning a froth treatment unit independent of upstream operations and allows unit turndown to match variations in bitumen supply.

More particularly, a portion of the $1^{st}$ stage O/F is preferably recycled back into the bitumen froth upstream of the $1^{st}$ stage mixer 28. At its temperature and pressure conditions, the $1^{st}$ stage O/F is saturated with asphaltenes and thus the first stage recirculation 52 replaces froth with $1^{st}$ stage O/F acting generally as a diluent. In other words, the dilbit contains its maximum concentration of asphaltenes and cannot receive additional asphaltenes when mixed with the heated froth 16 and first solvent containing stream 26. By way of example, in a paraffinic froth treatment process, the dilbit may contain about ⅓ bitumen with 10% of the bitumen being asphaltenes and about ⅔ of solvent. In a naphthenic process, the dilbit contains about ⅓ naphthenic solvent. In addition, with essentially a clean hydrocarbon stream, little valve erosion ensures reliable operation in this mode.

In paraffinic froth treatment (PFT), recycling $1^{st}$ stage O/F at its saturation point with respect to asphaltenes for blending with froth prior to the mixer may be performed to act as a viscosity modifying agent chemical additive that does not increase asphaltene precipitation. As $1^{st}$ stage O/F is saturated with asphaltenes, reducing the S/B ratio with froth promotes solubility stability while diluting bitumen viscosity.

In one aspect, the $1^{st}$ stage U/F is recycled back to the bottom of the FSV below the hydrocarbon-water interface.

In another aspect, the $2^{nd}$ stage O/F is recycled back into the $1^{st}$ stage U/F stream upstream of the $2^{nd}$ stage mixer. As $2^{nd}$ stage O/F is partially saturated by asphaltenes, replacing $1^{st}$ stage U/F with $2^{nd}$ stage O/F effectively dilutes the stream. The low bitumen content of $1^{st}$ stage U/F mitigates asphaltene precipitation in the mixer. It is also noted that the $2^{nd}$ stage O/F may be recirculated into the $2^{nd}$ stage solvent feed stream prior to addition to the $1^{st}$ stage U/F stream or into a combination of solvent feed and $1^{st}$ stage U/F.

In another preferred aspect, the $2^{nd}$ stage U/F recirc is returned back to the bottom of the second stage FSV below the hydrocarbon-water interface.

In another preferred aspect, both O/F recirc streams and both U/F return streams operate near the operating pressure of the FSU system which minimizes differential pressure across flow control valves which reduces both power and erosion in the recirc operating mode. In addition, the froth and U/F low flow transition may occur when froth and U/F pumps are at or below minimum flow requirements for the pumps and the valves redirecting the recirculation stream may only operate in an on/off mode.

In another aspect, the froth pumps 24 pressurize froth from near atmospheric pressure to FSU process pressure. The $1^{st}$ stage O/F recirc could "back off" the froth pumps, in the case of variable speed control pumps, until minimum flow provisions on the pump discharge occur at which time the minimum flow would divert froth back to the froth heater.

In transitioning to turndown mode, the process may employ a number of control strategies and operating schedules. In one embodiment, the transition to turndown mode includes, for instance in response to a bitumen froth supply reduction, increasing the $1^{st}$ stage O/F recirc flow rate. Maintaining a constant froth feed supply to the mixer, the variable speed froth pump reduces the flow rate of froth supplied from the froth tank. The froth pump flow reduction continues until the pump reaches a minimum flow requirement, according to equipment specifications. In order to further increase the proportion of $1^{st}$ stage O/F recirc provided as feed relative to untreated heated froth, the froth recirc valve may be switched to an open position thus allowing flow through the froth recirc line.

In one optional aspect, the supplied bitumen froth is deaerated prior to heating to produce the heated froth which is pumped and blended with $2^{nd}$ stage O/F, which may be referred to as "a first solvent containing stream". To maintain a constant feed to the $1^{st}$ stage FSV with froth feed variations, $1^{st}$ stage O/F is recycled to froth feed which by pressure balance or similar control causes froth pumps to turn down. For paraffinic froth treatment (PFT), as $1^{st}$ stage O/F is at its saturation point with respect to asphaltenes, blending with froth prior to the mixer does not increase asphaltene precipitation, however due to the volumetric flow critical line velocities above critical setting velocities are maintained while froth flow reduces. In event the froth flow is less than the minimum flow required for stable pump operation, froth is diverted back to the froth heater and an interlock valve is closed to prevent solvent flowing to the froth tank and causing a safety or environmental issue due to solvent flashing in the froth tank.

$1^{st}$ stage U/F is pumped and blended with feed solvent. To maintain a constant feed to the $2^{nd}$ stage FSV with $1^{st}$ stage U/F variations resulting from froth feed variations, $2^{nd}$ stage O/F is recycled to either the $1^{st}$ stage U/F as shown in the figure which by pressure balance or similar control causes $1^{st}$ stage U/F pumps to turn down. As $2^{nd}$ stage O/F is partially saturated with asphaltenes and the bitumen content of $1^{st}$ stage U/F is limited, blending with $1^{st}$ stage U/F prior to the mixer does not notably increase asphaltene precipitation, however the volumetric flow maintains critical line velocities above critical setting velocities while $1^{st}$ stage U/F flow reduces. The control scheme provides maintaining the $1^{st}$ stage U/F flow the minimum flow required for stable pump operation by diverting $1^{st}$ stage U/F back to the FSV via an interlock valve to prevent reverse flow of solvent to the FSV and leading to safety or environmental issues.

Activation of either the froth interlock valve or the $1^{st}$ stage U/F interlock valve for minimum flow protection would cause other valves noted in FIG. 1 to close placing the FSU in a standby/recycle operational mode. This includes diverting the $2^{nd}$ stage U/F to the $2^{nd}$ stage FSV and closing an interlock valve to maintain levels in the $2^{nd}$ stage FSV and prevent plugging the $2^{nd}$ stage U/F outlet.

The recirculation of $1^{st}$ or $2^{nd}$ stage O/F back to the respective FSVs via feed systems ensures the O/F pumps operate above minimum flow rates for stable operation.

In a preferred aspect, a control scheme responds to a step change in froth flows and as a master control strategy reduces risk of operator error in timing the appropriate control response required in the current operating strategy.

In another optional aspect, the recirculation strategy for the FSU is coupled with recirculation controls in the solvent recovery unit (SRU) and tailings solvent recovery unit (TSRU) to maintain stable froth treatment plant operations over with ranges of froth feed rates and qualities.

It is also noted that the FSU can be put on standby mode with full internal recirculation and where the effective flows for the froth, produced dilbit, produced solvent diluted tailings and fresh solvent are brought to zero.

Figure 2:
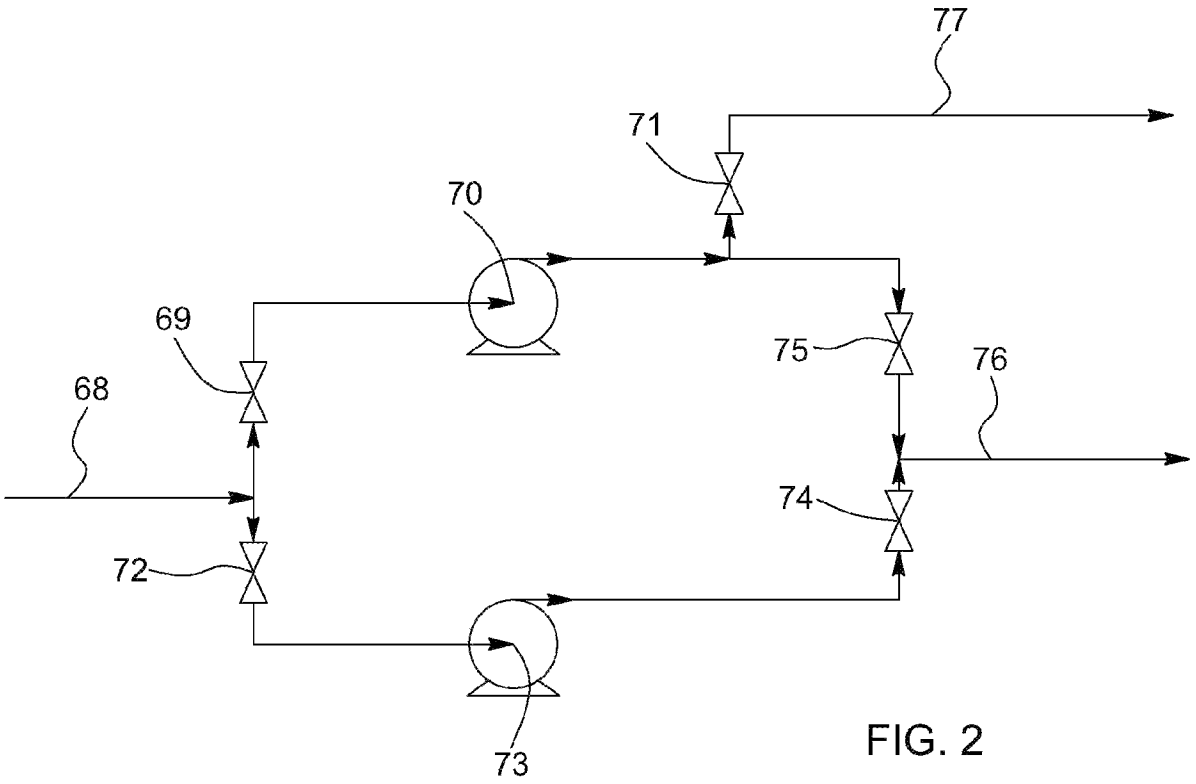
FIG. 2 is a process flow diagram of a pump and valve arrangement that may be used with embodiments of the present invention.

FIG. 2 identifies a scheme where an installed spare froth or U/F pump can aid transitioning to reduced flows. In this scheme, one U/F has valves that permit the pump to recirculate the stream back to storage or U/F back to the settler vessel. The control algorithm would permit the operating pump speed to control the flow to the next unit operation. When the flow falls to a preset value, the stand-by spare pump is started with valves sequenced to route back to the feed vessel and by setting the pump at a preset speed above greater of minimum pump flows or settling in the source outlet. If the froth or U/F flow transferred to the next process continues to decline the pump is stopped and isolated by the valves.

The following legend outlines the elements in FIG. 2:

68 slurry from tank or settler
69 first pump isolation valve
70 slurry pump (1 of 2 installed units)
71 recirculation isolation valve
72 second pump isolation valve
73 slurry pump (2 of 2 installed units)
74 third pump isolation valve
75 fourth pump isolation valve
76 slurry to next step or stage of process
77 slurry to tank or settler It is noted that minimum flow requirement for a pump is specific to the given selected pump and results in certain limitations to the FSV turndown possibilities. To achieve the minimum desired turndown, careful selection of pumps is preferred. Alternately, where FSU multiple trains operate in parallel, each train for example including a system as illustrated in FIG. 1, the turndown strategy can be distributed across the trains: e.g. for two trains each allowing turndown from 100% froth feed to 50% froth feed, if further turndown is required, one train is placed in full internal recirc mode and the other ramps between 100% or 50%: effectively permitting a 100% to 25% turndown in froth feed. Where two or more trains are in parallel, the control strategy could turn a first train to a minimum (e.g. predetermined) production level before turning down second or third trains in a serial manner or, alternatively, could turn all trains down simultaneously prior to placing one or more of the trains in standby mode.

It is also noted that analogous control strategies may be used in connection with SRUs and/or TSRUs.

EXAMPLE

A HYSYS™ dynamic simulation model was built and run to test the froth separation unit control and recirculation system. The results of the model test were that the control system was able to handle and control a step change drop of about 50% in feed flow from the froth tank to the 1$^{st}$ stage settler. The recirculation loops were able to bring flows back to the minimum flows as specified in the model. The solvent to bitumen ratio (S/B) controller was able to bring the ratio back after the initial spike due to the drop in fresh feed flow.

More particularly, the model was a dynamic simulation built in HYSYS™ v7.1. The component slate was simplified and selected to give a vapour and two liquid phases, and have the ability to measure an S/B ratio. All the unit operations were included and modeled as best fit within HYSYS™. Pumps were all modelled as standard HYSYS™ centrifugal pumps with performance curves, settlers were modelled as vertical 3-phase vessels with internal weir enabled—the overflow side of the weir is used to simulate the overflow vessels on the settlers. All proposed controllers were included with generic tuning parameters, which control the system process variable (PV) to match a set point (SP). The control algorithm incorporated master PV controllers such as S/B ratio to relate froth and solvent flows and maintain relative material balance relationship between the process streams involved. In this specific simulation, the solvent flows were assigned a slave relationship relative to the bitumen flow; that is, the solvent controller SP was reset based on the bitumen froth flow and the master S/B ratio.

With the recirculation loops incorporated into the dynamic HYSYS™ model, the simulation model was allowed to run 5 minutes to permit PVs to line out to the controller SP prior to introducing about a 50% step change in the froth feed flow. The simulation was then run for an additional 55 minutes and the added control system response as illustrated on FIGS. 3*a*, 3*b* and 3*c* was observed.

Figure 3A:
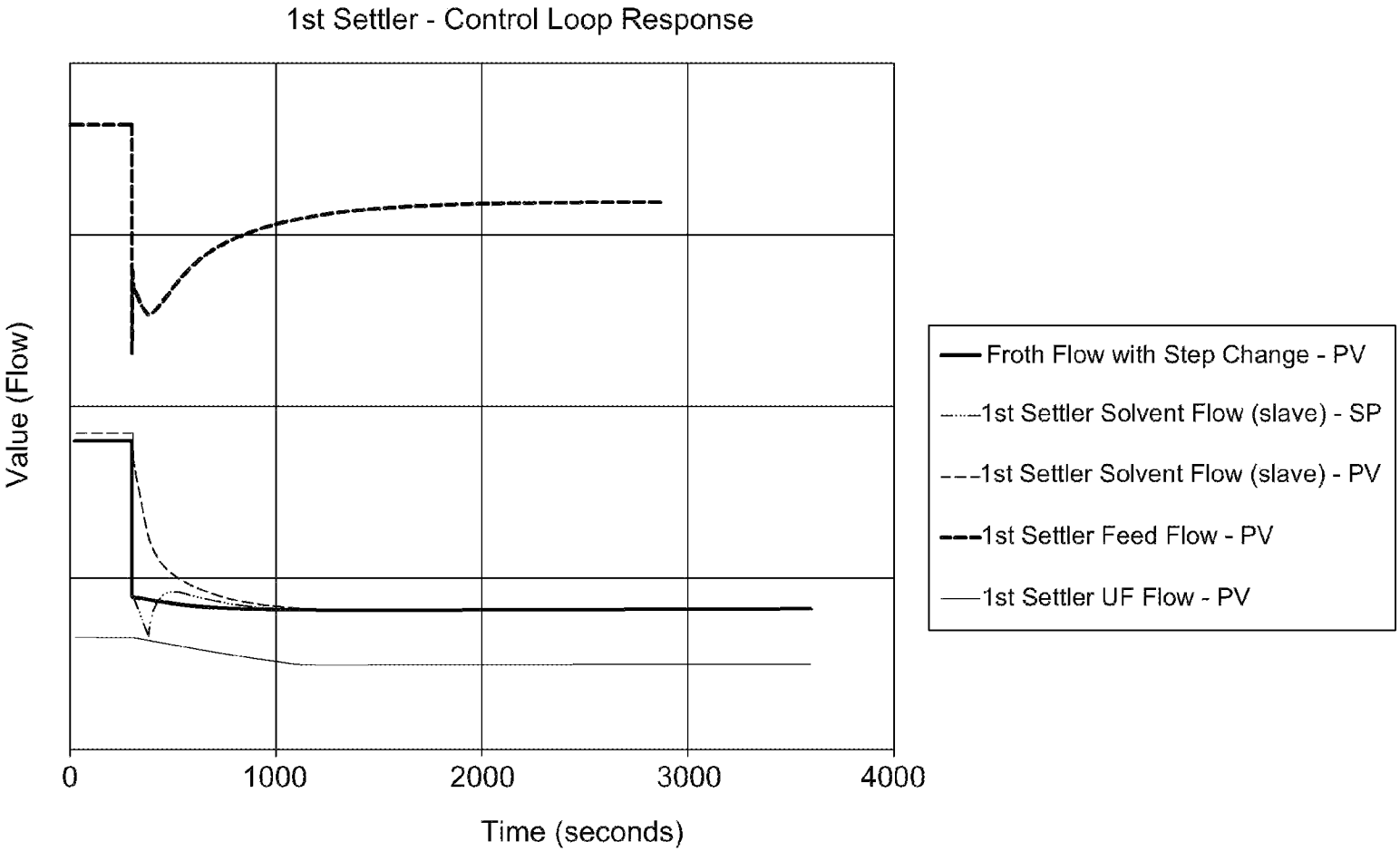
FIGS. 3*a*-3*c* are graphs of control loop response for several variables versus time as per an example HYSYS™ simulation.

Step change in froth flow illustrated in FIG. 3*a* resulted in reducing the settler solvent flow reflecting the S/B ratio master controller which to the tuning parameters selected cause the settler solvent flow SP to over shoot, then over correct, then stabilize in about 11 minutes from the froth flow step change. During this time the 1$^{st}$ stage O/F recirc increases the 1$^{st}$ stage settler feed flow and the 1$^{st}$ stage U/F reduces in response to the reduced froth flow rate. With the recycle controls, the 1$^{st}$ stage settler in terms of O/F and U/F streams is stable about 20 minutes after the froth flow step change.

Figure 3B:
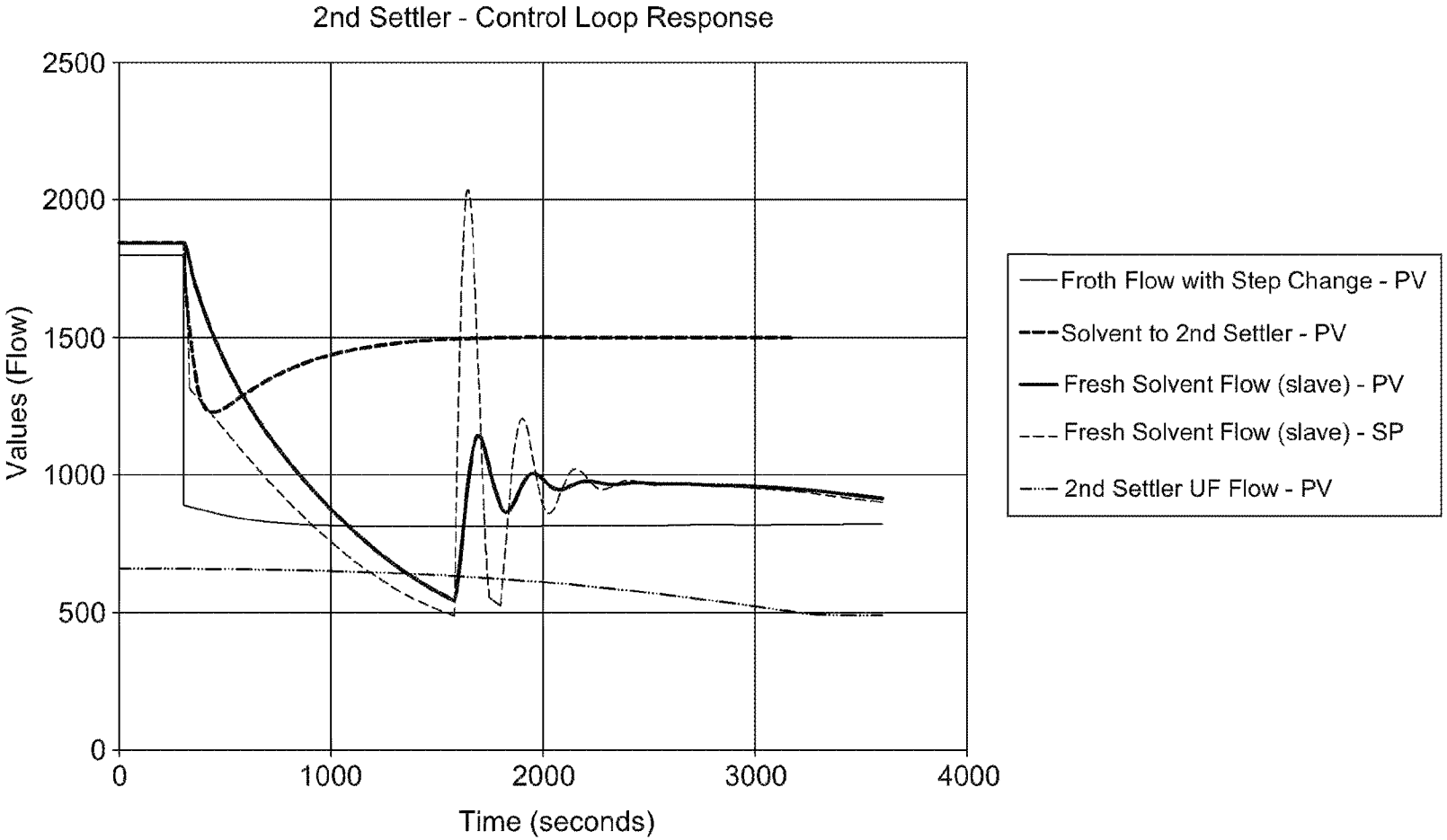

As a result of the inventory in the 1$^{st}$ stage separation vessel, the step change in froth flow as illustrated in FIG. 3*b* results in a delayed response. Again, the solvent flows are adjusted to reflect the process requirements with the solvent flow control SP reset by slave relationship and stabilize to 2$^{nd}$ stage settler in terms of O/F and U/F streams about 60 minutes after the froth flow step change.

Figure 3C:
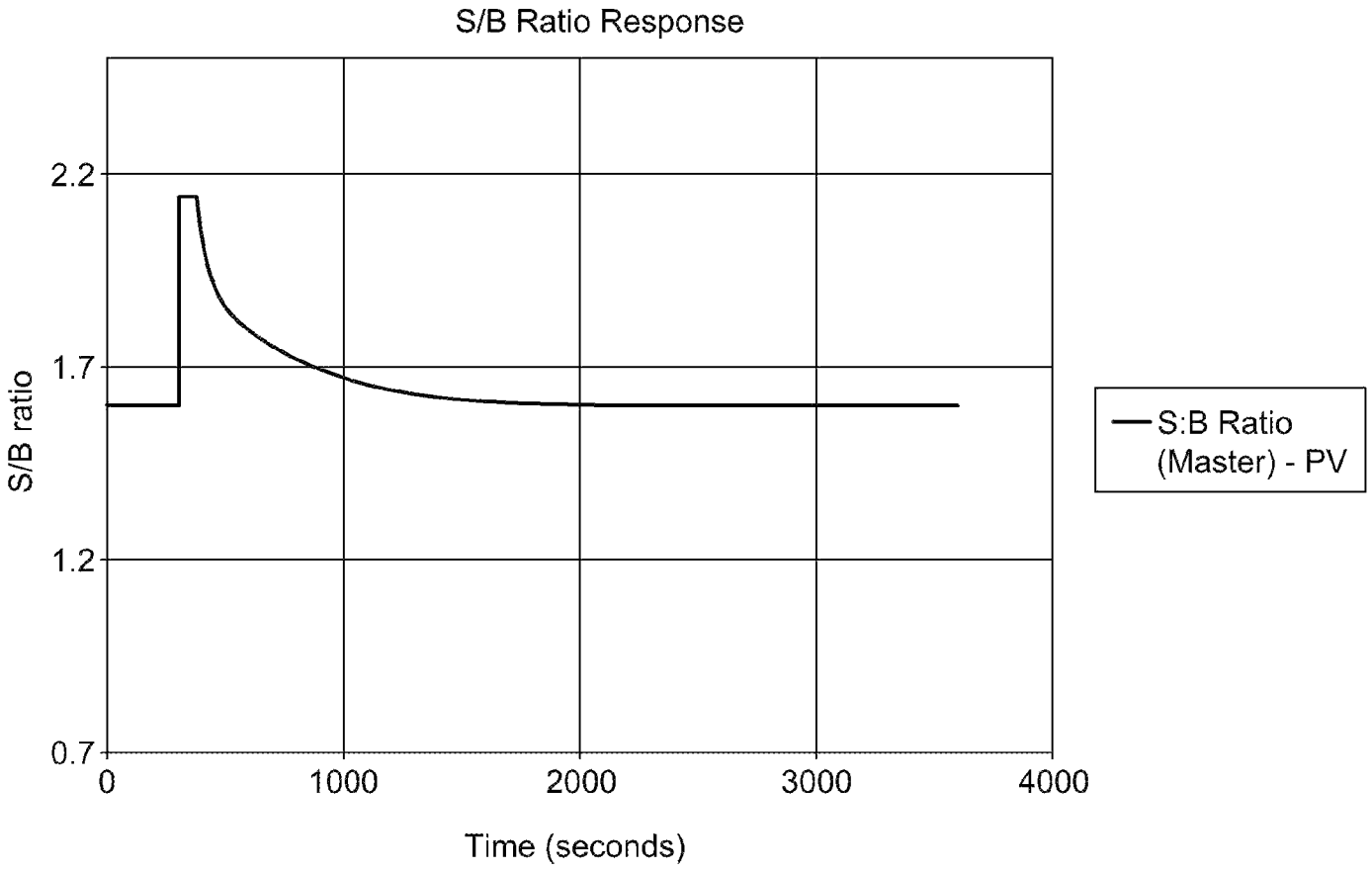
Figure 4A:
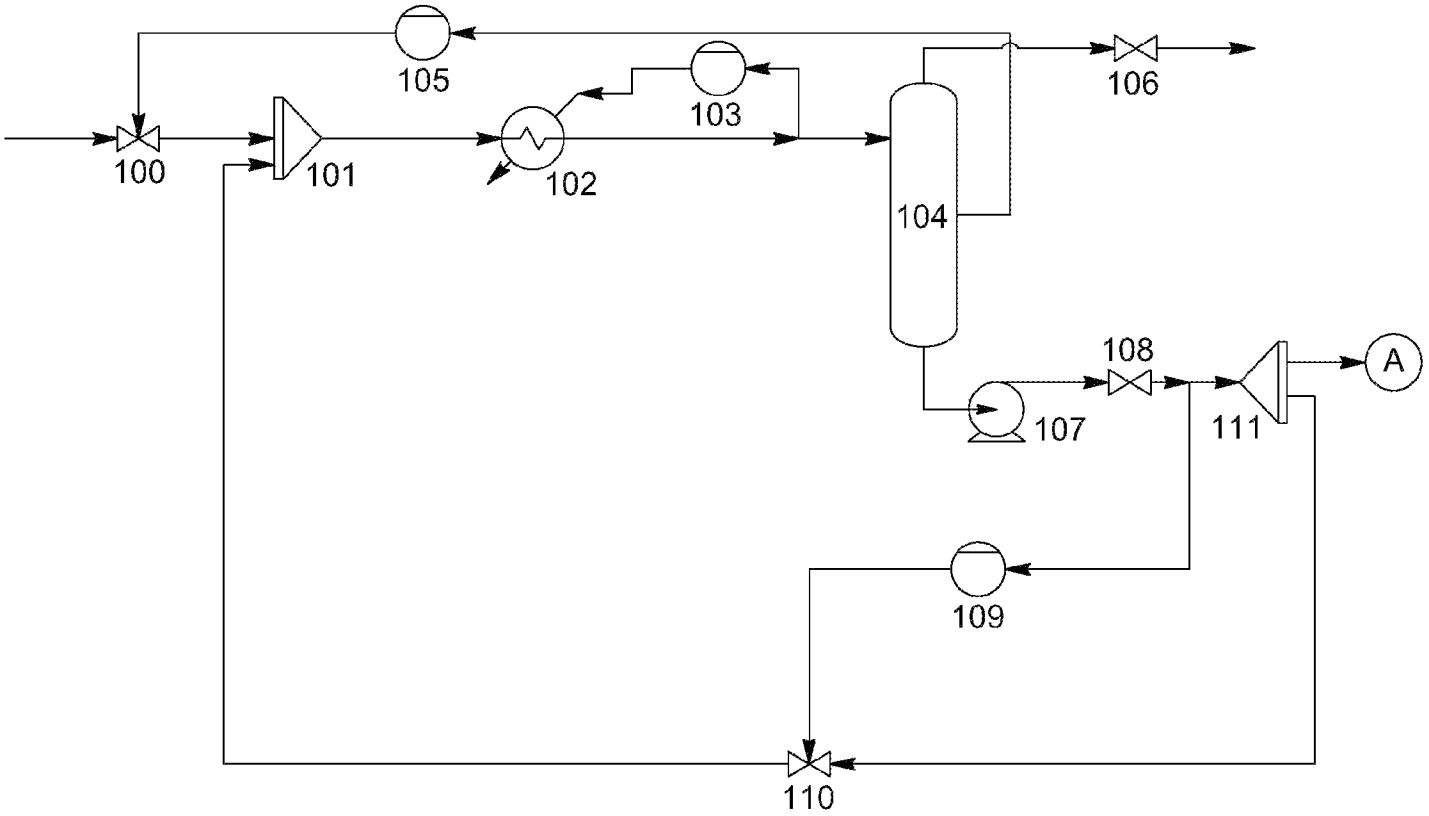
FIGS. 4*a* to 4*e*, collectively referred to herein as FIG. 4, constitute a process flow diagram of an embodiment used in an example HYSYS™ simulation.
Figure 4B:
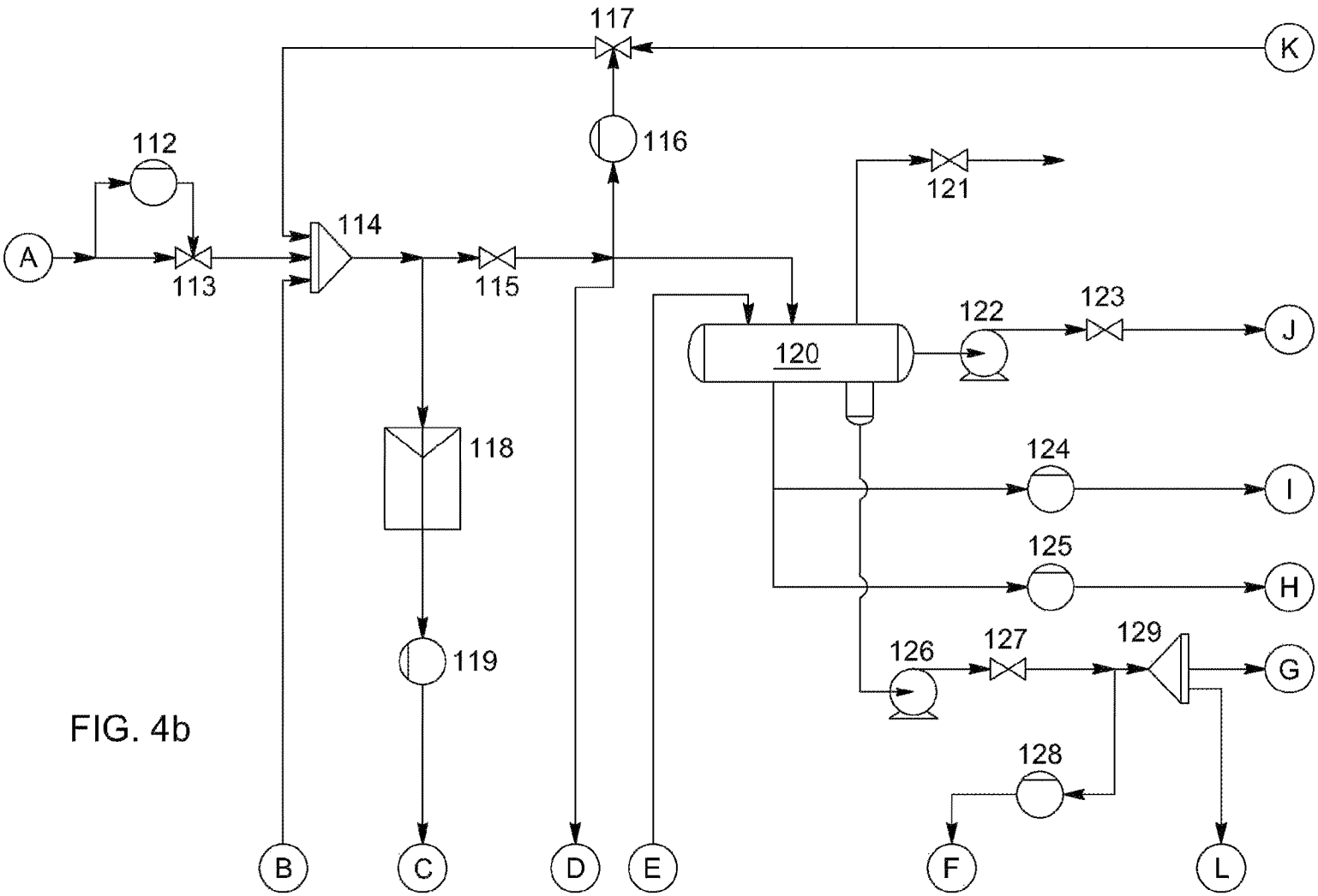
Figure 4C:
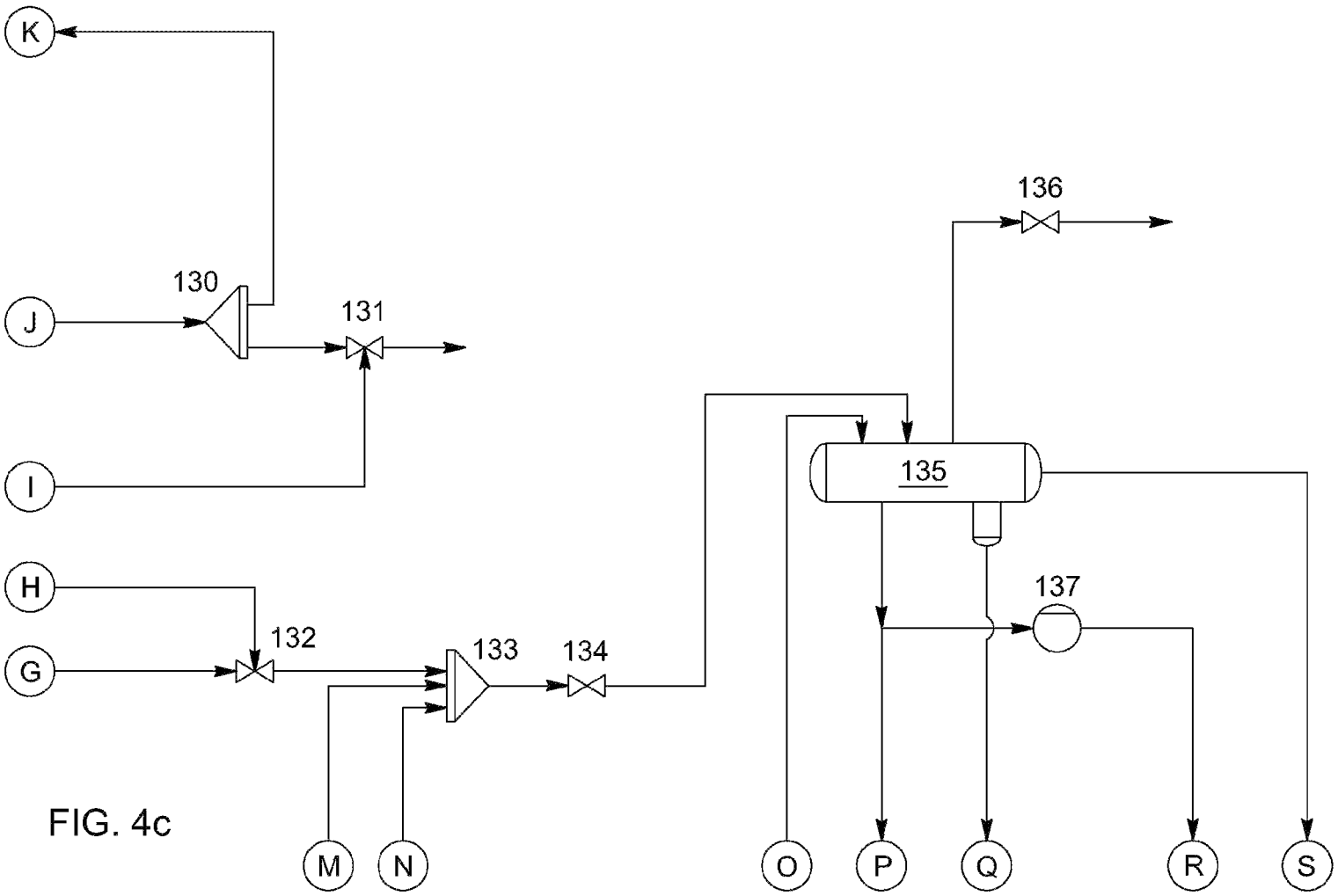
Figure 4D:
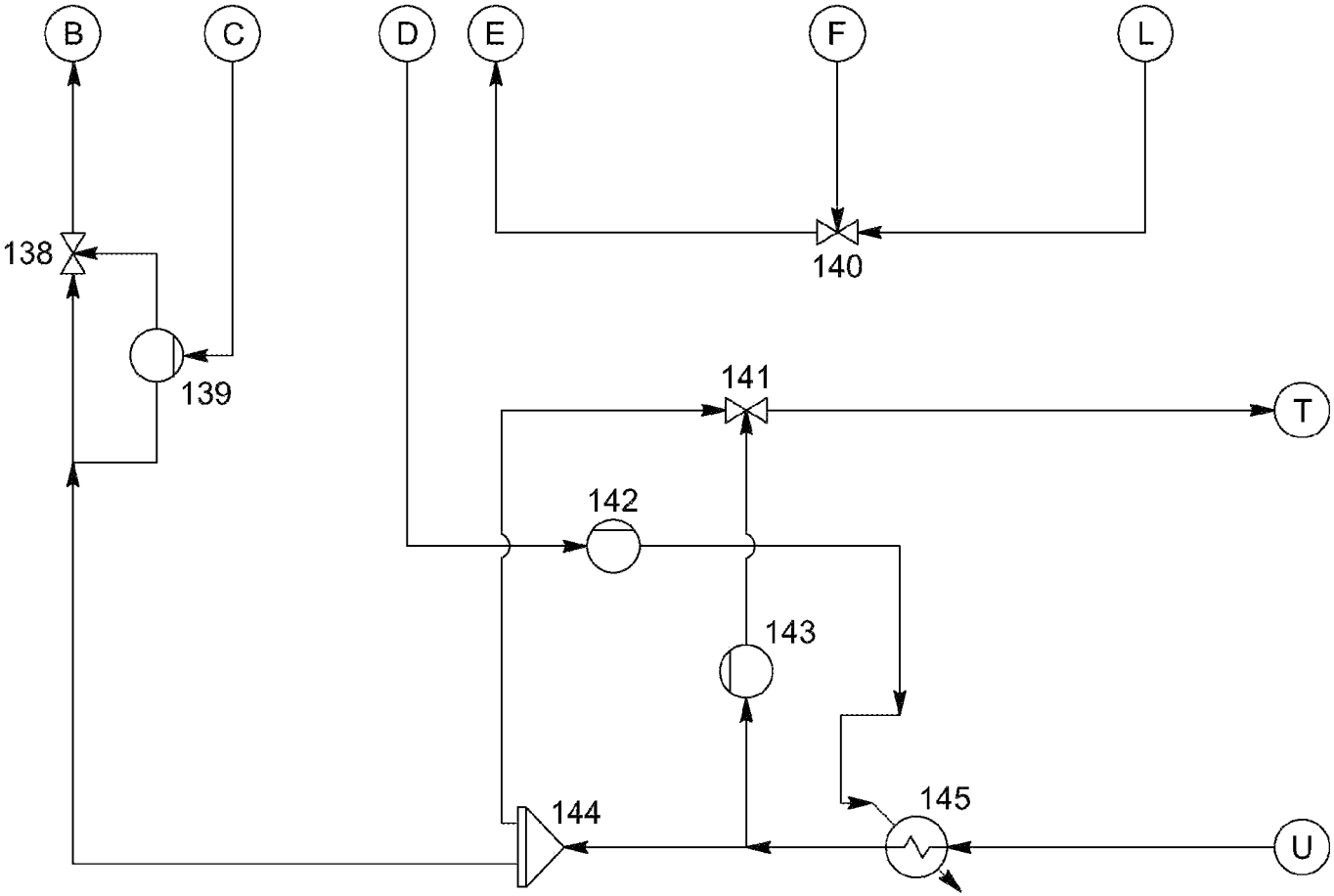
Figure 4E:
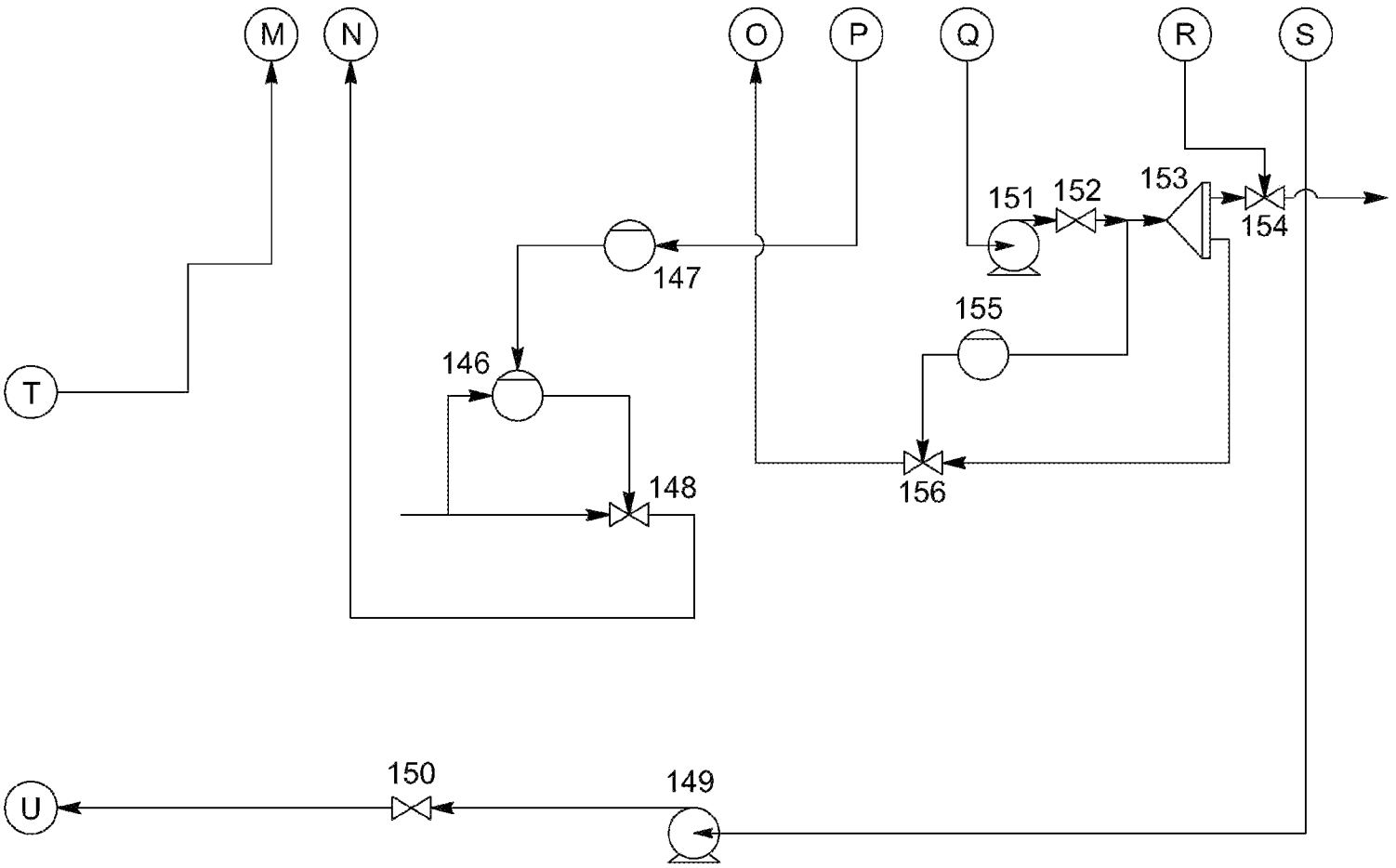

As illustrated in FIG. 3*c* with recycle the variation in S/B PV is limited to the time frame that the 1$^{st}$ stage settler is stabilizing despite the delayed response on the 2$^{nd}$ stage separation vessel.

The added control system was able to respond to the feed step change. The recirculation controllers worked as designed and were able to bring flows back to stable flows. The S/B controller had a spike in S/B ratio from 1.6 to 2.15, but was able to respond and bring the ratio back to 1.6. Tuning of the S/B master controller and slave flow controller resulted in a faster response in S/B ratio.

In terms of model limitations, it is noted that the model used a simplified component slate. Vessels (used for froth tank and settlers) assume perfect mixing in the phases. The process lags or dead time in the model reflect inventories within process vessels without allowing for the limited piping volumes and associated inventories in paraffinic froth treatment process. Hence, the control loop responses illustrated in FIGS. 3*z*, 3*b*, and 3*c* could be optimized.

The control methodology concepts may be adapted and structured to auto-control other potential process supply limitations such as solvent.

In reference to FIGS. 4*a*-4*e*, the following legend outlines process elements in the simulation:

100 froth valve
101 mixer
102 heat exchanger
103 froth tank feed temperature control
104 froth tank
105 froth tank level control
106 froth tank overhead valve
107 froth tank pump
108 froth tank pump valve
109 froth tank minimum flow control
110 froth tank minimum flow control valve
111 froth tee
112 dummy feed flow
113 dummy feed flow valve

114 mixer
115 valve
116 first settler feed minimum flow control
117 valve
118 Sampler analyzer
119 S/B ratio control (master)
120 first stage settler
121 valve
122 first stage overflow pump
123 valve
124 first stage settler overflow level control
125 first stage settler underflow level control
126 first stage settler underflow pump
127 valve
128 first stage settler underflow flow control
129 first stage settler underflow tee
130 first stage settler overflow tee
131 valve
132 valve
133 first stage settler underflow mixer
134 valve
135 second stage settler
136 valve
137 second stage underflow level control
138 valve
139 first stage settler solvent flow control (slave)
140 valve
141 valve
142 first stage settler feed temperature control
143 excess solvent to second settler control
144 second stage overflow tee
145 second stage overflow heat exchanger
146 fresh solvent flow control (slave)
147 second stage settler overflow level control (master)
148 fresh solvent valve
149 second stage settler overflow pump
150 second stage settler overflow valve
151 second stage settler underflow pump
152 second stage settler underflow valve
153 second stage settler underflow tee
154 second stage settler underflow tee valve
155 second stage settler underflow minimum flow control
156 second stage settler underflow recycle valve Finally, the present invention should not be limited to the particular examples, figures, aspects and embodiments described herein.

The invention claimed is:

1. A process for operating a bitumen froth treatment operation in turndown mode, comprising:

adding a solvent containing stream to bitumen froth to produce diluted bitumen froth;

separating the diluted bitumen froth into a diluted bitumen component and a solvent diluted tailings component; and in response to a reduction in flow of the bitumen froth:

recirculating a portion of the diluted bitumen component into the bitumen froth as a recirculated dilbit component; and returning a portion of the solvent diluted tailings component into the step of separating as a returned solvent diluted tailings component.

2. The process of claim 1, wherein the step of separating is performed in a separation apparatus comprising:

a first stage separation vessel receiving the diluted bitumen froth and producing the diluted bitumen component and a first stage underflow component; and a second stage separation vessel receiving the first stage underflow component and producing the solvent diluted tailings components and a second stage overflow component.

3. The process of claim 2, comprising returning a portion of the first stage underflow component into the first stage separation vessel.

4. The process of claim 2, comprising returning a portion of the second stage underflow component into the second stage separation vessel.

5. The process of claim 2, comprising recirculating a portion of the second stage overflow component into the bitumen froth and/or into the first stage underflow.

6. The process of claim 2, wherein the solvent containing stream added to the bitumen froth comprises at least a portion of the second stage overflow component.

7. The process of claim 6, comprising heating the second stage overflow component prior to using as the solvent containing stream.

8. The process of claim 2, comprising adding a second stage solvent containing stream to the first stage underflow component.

9. The process of claim 1, comprising pre-heating the bitumen froth to produce heated bitumen froth prior to adding the solvent containing stream thereto.

10. The process of claim 9, comprising recirculating a portion of the heated bitumen froth back into the bitumen froth upstream of the pre-heating.

11. The process of claim 1, comprising regulating the flows of the recirculated dilbit component and the returned solvent diluted tailings component in response to the reduction in flow of the bitumen froth.

12. The process of claim 1, wherein the step of separating is performed in a separation apparatus comprising:

a first stage separation vessel receiving the diluted bitumen froth and producing a first stage overflow component as the diluted bitumen component and a first stage underflow component;

an addition line for adding make-up solvent to the first stage underflow component to produce a diluted first stage underflow component; and a second stage separation vessel receiving the diluted first stage underflow component and producing a second stage underflow component as the solvent diluted tailings components and a second stage overflow component; and wherein the process comprises:

(a) recirculating a portion of the first stage overflow component into the bitumen froth as a dilbit recirculation stream;

(b) returning a portion of the first stage underflow component into the first stage separation vessel as a first stage return stream;

(c) recirculating a portion of the second stage overflow component into the first stage underflow as a second stage recirculation stream; and (d) returning a portion of the second stage underflow component into the second stage separation vessel as a second stage return stream.

13. The process of claim 12, wherein sub-steps (a), (b), (c) and (d) are initiated sequentially.

14. The process of claim 12, wherein in sub-step (a) the dilbit recirculation stream is provided with a flow corresponding to the reduction in the flow of the bitumen froth.

15. The process of claim 12, wherein in sub-step (b) the first stage return stream is returned below an hydrocarbon-water interface within the first stage separation vessel and/or is returned to provide a velocity of the first stage underflow component sufficient to avoid solids settling and asphaltene mat formation.

16. The process of claim 12, wherein in sub-step (c) the second stage recirculation stream is provided with a flow corresponding to the reduction in flow of the first stage underflow component due to the first stage return stream.

17. The process of claim 12, wherein in sub-step (d) the second stage return stream is returned below an hydrocarbon-water interface within the second stage separation vessel and/or is returned to provide a velocity of the second stage underflow component sufficient to avoid solids settling and asphaltene mat formation.

18. The process of claim 12, wherein sub-steps (a) and (c) are performed such that flows of the dilbit recirculation stream and the second stage recirculation stream are sufficient to avoid settling of solids in respective recirculation piping systems.

19. The process of claim 12, comprising sub-step (e) of recycling a portion of the bitumen froth back upstream.

20. The process of claim 19, wherein step (e) is initiated in response to an additional reduction in the flow of the bitumen from below a given flow value.

21. The process of claim 20, wherein the given flow value corresponds to a minimum pump requirement flow for pumping the bitumen froth.

22. The process of claim 12, comprising two parallel trains each comprising at least one of the separation apparatus.

23. The process of claim 12, wherein the bitumen froth treatment operation is a paraffinic froth treatment operation and the solvent is paraffinic solvent.

24. The process of claim 12, wherein the bitumen froth treatment operation is a naphthenic froth treatment operation and the solvent is naphthenic solvent.

25. The process of claim 12, comprising following a control strategy comprising flow control of the bitumen froth, the diluted bitumen component, the first stage underflow component, the second stage overflow component and the solvent diluted tailings component and the make-up solvent to maintain material balance.

26. The process of claim 25, wherein the control strategy comprises acquiring flow measurements of hydrocarbon-rich streams.

27. The process of claim 25, wherein the control strategy comprises acquiring measurements of solvent, bitumen, water and/or mineral content in the solvent diluted froth or the diluted first stage underflow component.

28. The process of claim 25, wherein the control strategy comprises solvent-to-bitumen ratio (S/B) control.

29. The process of claim 28, wherein the S/B control comprises designating a master stream relative to a slave stream.

30. The process of claim 25, wherein the control strategy comprises level control of bitumen froth in a froth tank, first stage separation vessel overflow, first stage separation vessel water-hydrocarbon interface, second stage separation vessel overflow and second stage separation vessel water-hydrocarbon interface.

31. The process of claim 30, wherein the level control comprises adjusting pump speed, adjusting pump discharge valve or adjusting pump bypass recirculation valve or a combination thereof to maintain a stable level.

32. The process of claim 28, comprising controlling the S/B ratio in the diluted froth stream.

33. The process of claim 1, comprising following a control strategy comprising flow control of the bitumen froth, the diluted bitumen component, the solvent diluted tailings component, and the solvent, to maintain material balance.

34. A process for producing bitumen from a bitumen froth treatment operation in turndown mode, comprising:

adding a solvent containing stream to bitumen froth to produce diluted bitumen froth;

separating the diluted bitumen froth into a diluted bitumen component and a solvent diluted tailings component;

producing the bitumen from the diluted bitumen component; and in response to a reduction in flow of the bitumen froth:

recirculating a portion of the diluted bitumen component into the bitumen froth as a recirculated dilbit component.

35. A process for producing bitumen from a bitumen froth treatment operation in turndown mode, comprising:

adding a solvent containing stream to bitumen froth to produce diluted bitumen froth;

separating the diluted bitumen froth into a diluted bitumen component and a solvent diluted tailings component;

producing the bitumen from the diluted bitumen component; and in response to a reduction in flow of the bitumen froth:

returning a portion of the solvent diluted tailings component into the step of separating as a returned solvent diluted tailings component.

* * * * *